US012422150B2

(12) United States Patent
Choi et al.

(10) Patent No.: US 12,422,150 B2
(45) Date of Patent: Sep. 23, 2025

(54) AIR CONDITIONER AND INSTALLATION KIT

(71) Applicant: LG ELECTRONICS INC., Seoul (KR)

(72) Inventors: Sungsik Choi, Seoul (KR); Hongseung Do, Seoul (KR); Yejin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 197 days.

(21) Appl. No.: 18/196,277

(22) Filed: May 11, 2023

(65) Prior Publication Data

US 2023/0366564 A1 Nov. 16, 2023

(30) Foreign Application Priority Data

May 13, 2022 (KR) ..... 10-2022-0058734

(51) Int. Cl.

| | |
|---|---|
| ***F24F 1/031*** | (2019.01) |
| ***F24F 1/027*** | (2019.01) |
| *F24F 13/32* | (2006.01) |

(52) U.S. Cl.

CPC ..... *F24F 1/031* (2019.02); *F24F 1/027* (2013.01); *F24F 13/32* (2013.01)

(58) Field of Classification Search

CPC .. F24F 1/031; F24F 1/027; F24F 13/32; F24F 13/20; F24F 13/24; F24F 2221/20; F24F 2013/247; E06B 7/02

See application file for complete search history.

(56) References Cited

FOREIGN PATENT DOCUMENTS

| | | | | |
|---|---|---|---|---|
| JP | H0658568 | A * | 3/1994 | |
| JP | 2005-024125 | | 1/2005 | |
| KR | 10-2020-0135085 | | 12/2020 | |
| KR | 10-2223240 | | 3/2021 | |
| KR | 20210136733 | A * | 11/2021 | ..... F24F 13/0254 |
| WO | WO-2021243010 | A1 * | 12/2021 | ..... F24F 1/031 |

OTHER PUBLICATIONS

Korean Office Action dated Nov. 23, 2023 issued in Korean Application No. 10-2022-0058734.

* cited by examiner

*Primary Examiner* — Emmanuel E Duke

(74) *Attorney, Agent, or Firm* — KED & ASSOCIATES, LLP

(57) ABSTRACT

An installation kit includes: a front panel disposed to cover an indoor side of a space in which an air conditioner is disposed between a window frame and a window, the front panel having an opening through which the air conditioner is inserted; a first side frame coupled to the front panel, and disposed to face the window; and a second side frame coupled to the front panel, and disposed to face the window frame, thereby stably installing the air conditioner in the window.

19 Claims, 23 Drawing Sheets

AIR CONDITIONER AND INSTALLATION KIT

CROSS-REFERENCE TO RELATED APPLICATION(S)

This application claims priority under 35 U.S.C. § 119 to Korean Application No. 10-2022-0058734 filed in Korea on May 13, 2022, whose entire disclosure is hereby incorporated by reference. This application is also related to U.S. patent application Ser. No. 18/196,331 filed on May 11, 2023, whose entire disclosure is also hereby incorporated by reference.

BACKGROUND

1. Field

An air conditioner and an installation kit are disclosed herein.

2. Background

An air conditioner is a device for supplying conditioned air to an indoor space by at least one of cooling, heating, or purifying intake air. A window-mounted air conditioner is mounted between a window frame and a window and supplies conditioned air to an indoor space. The window-mounted air conditioner has an inlet and an outlet which are open toward the indoor space, and an outer side that is disposed opposite to the outlet and that faces the outside.

A heat pump device for circulating refrigerant may be disposed in the air conditioner. The heat pump device typically generates vibration and noise. In the window-mounted air conditioner, the vibration and noise generated by the heat pump device may be transmitted to the indoor space through the window frame and the window. Thus, in a typical window-mounted air conditioner, vibration and noise generated therein may be transmitted to a room, thereby causing discomfort to a user.

Furthermore, a typical window-mounted air conditioner may continuously hit against the window frame and window, such that the case may be damaged. In addition, a typical window-mounted air conditioner may have a drawback that water generated in the air conditioner and rainwater entering from the outside may flow toward the front of the air conditioner and into the room. Moreover, a typical window-mounted air conditioner may have a gap between a case of the air conditioner and the window frame, such that unconditioned air may undesirably flow through the gap, and foreign matter may accumulate in the gap between the case and the window frame to deteriorate the appearance of the air conditioner.

BRIEF DESCRIPTION OF THE DRAWINGS

Embodiments will be described in detail with reference to the following drawings in which like reference numerals refer to like elements, and wherein.

DETAILED DESCRIPTION

Figure 1:
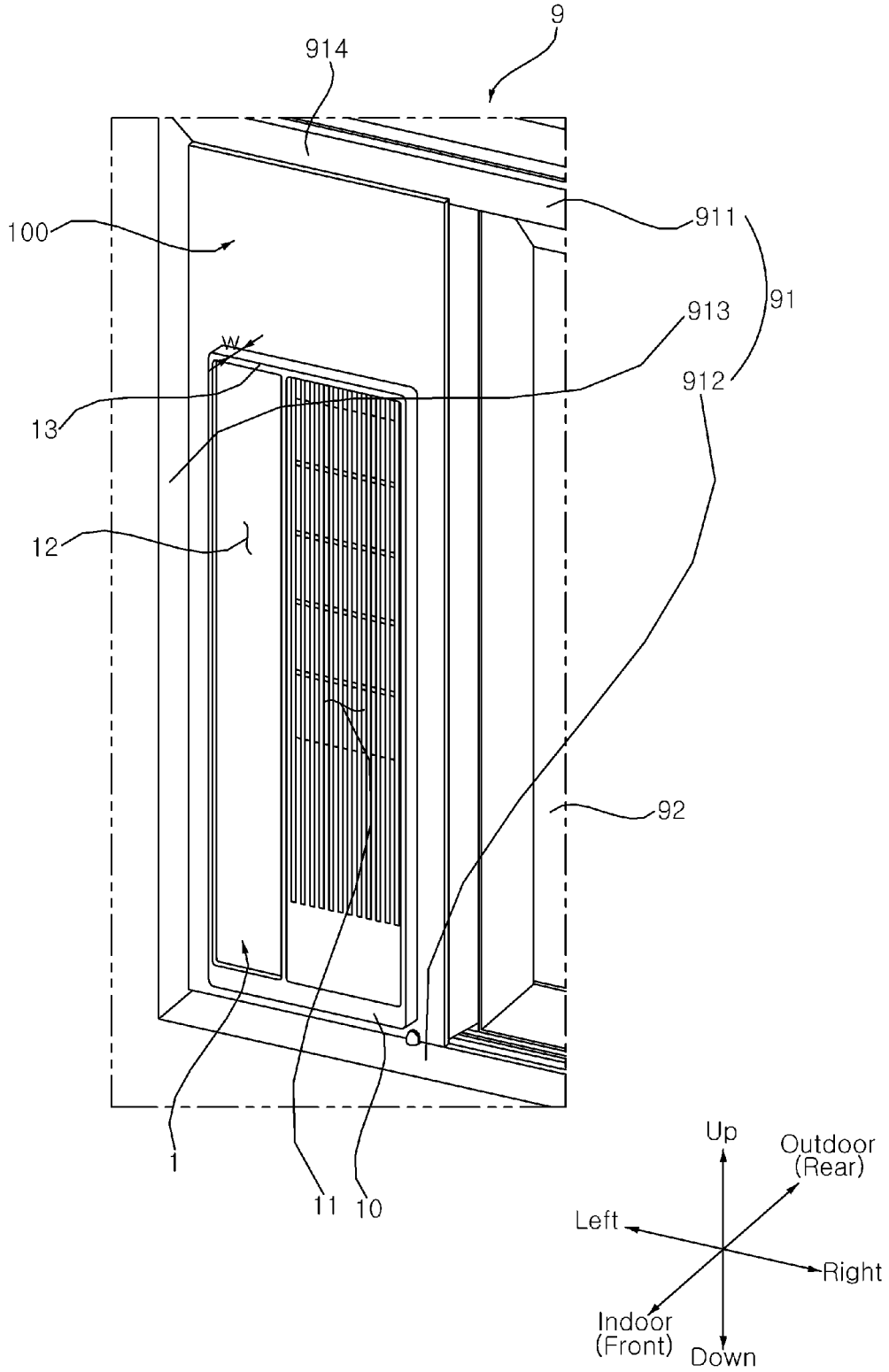
FIG. 1 is a diagram illustrating an air conditioner according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted. It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

The terms "module" and "unit" for elements used in the following description are given simply in view of the ease of the description, and do not have a distinguishing meaning or role. Furthermore, it will be understood that, although the terms first, second, etc., may be used herein to describe various elements, these elements should not be limited by these terms. These terms are only used to distinguish one element from another. It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the singular forms are intended to include the plural forms as well, unless the context clearly indicates otherwise.

Referring to FIG. 1, an air conditioner 1 and an installation kit (or installation cover) 100 will be described below. FIG. 1 is a diagram illustrating a state in which the air conditioner 1 is installed in a window assembly 9. The window assembly 9 may include a window frame 91 and a window (or sash) 92. The window 92 may be movably mounted on the window frame 91.

The window frame 91 may include an upper support (or head) 911. The window 92 may be coupled to the upper support 911 so as to be movable in a horizontal direction. When installed, the air conditioner 1 may be disposed below the upper support 911. The installation kit 100 may be disposed on a lower side of the upper support 911.

The window frame 91 may include a lower support (or sill) 912. The window 92 may be coupled to the lower support 912 so as to be movable in the horizontal direction, such as to slide horizontally between the upper support 911 and the lower support 912. When installed, the air conditioner 1 may be disposed above the lower support 912. The installation kit 100 may be disposed on an upper side of the lower support 912.

The air conditioner 1 may be disposed between the upper support 911 and the lower support 912. The window 92 may be disposed between the upper support 911 and the lower support 912. The installation kit 100 may be disposed between the upper support 911 and the lower support 912.

The window frame 91 may include a side support 913. The window 92 may move horizontally to be mounted on the side support 913. When installed, the air conditioner 1 may be disposed between the window 92 and the side support 913. The installation kit 100 may be disposed between the window 92 and the side support 913.

The air conditioner 1 may include a case 10. Components for operating the air conditioner 1 may be disposed in the case 10. The air conditioner 1 may have an inlet 11. The air conditioner 1 may include an outlet 12. The inlet 11 and the outlet 12 may be formed in a surface facing an indoor space. In other examples, the inlet 11 and the outlet 12 may be formed on different interior surfaces, such as upper and lower surfaces or left and right surfaces. The inlet 11 and the outlet 12 may be open toward the indoor space in the case 10.

The installation kit 100 may be disposed between the window frame 91 and the window 92. The case 10 of the air conditioner 1 may be supported by the installation kit 100. The installation kit 100 may be disposed to surround the case 10.

The window frame 91 may also include a window frame front end 914. The window frame front end 914 may refer to a side of the window frame 91 facing the indoor space. The window frame front end 914 may be disposed to face the indoor space.

The case 10 may include a case front end 13. The case front end 13 may refer to a side of the case 10 facing the indoor space. The case front end 13 may be disposed to face the indoor space.

The installation kit 100 may be coupled to the window frame front end 914. The installation kit 100 may be fixed to the window frame front end 914. The installation kit 100 may be disposed to face the indoor space. The installation kit 100 may surround the case front end 13. The installation kit 100 may support a front end of the air conditioner 1.

The case front end 13 may protrude further forward into the indoor space than the window frame front end 914. A front edge of the case front end 13 may protrude further toward the indoor space than a front edge of the window frame front end 914.

The case front end 13 may protrude further forward into the indoor space than a front surface of the installation kit 100. The front edge of the case front end 13 may protrude further toward the indoor space than a front surface of the front panel 110 (see FIG. 3). A gap w in a front-rear direction may be formed between a front surface of the case front end 13 and an adjacent surface of the installation kit 100, such that the gap w m represent a distance by which the front of the air conditioner 1 extends forward into the indoor space past the installation kit.

The installation kit 100 may be made of a same or similar material as the case 10. The installation kit 100 and the case 10 may have the same color. In one example, the front panel 100 (see FIG. 3) may be made of the same material as the case front end 13. The front panel 110 (see FIG. 3) may have the same color as the case front end 13. Accordingly, friction between the installation kit 100 and the case 10 may be minimized, the appearance may be improved, a manufacturing process may be simplified, production costs may be reduced, and noise and vibration generated in the case 10 may be reduced.

Figure 2:
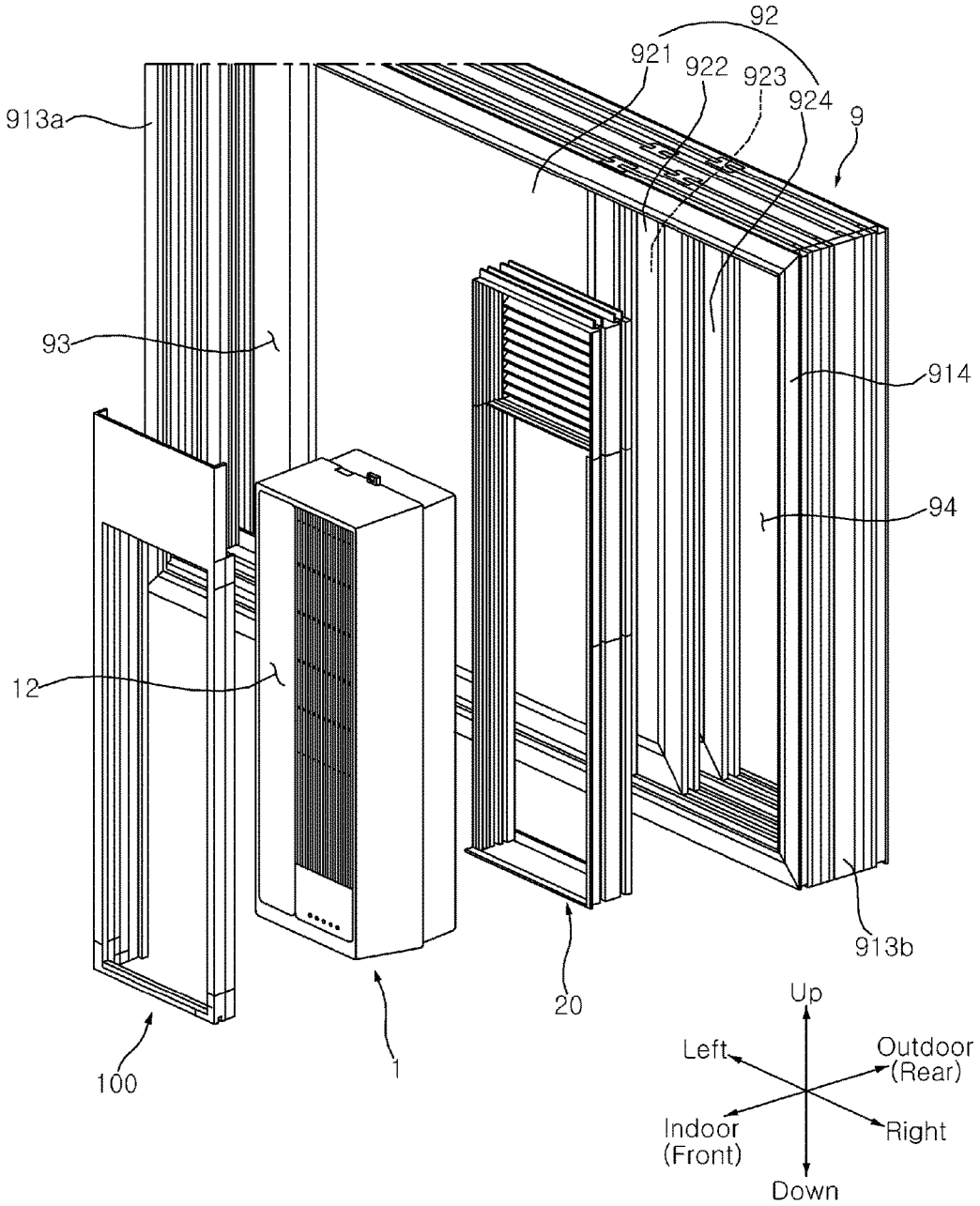
FIG. 2 is an exploded view of an air conditioner and an installation kit according to an embodiment of the present disclosure.

Referring to FIG. 2, the air conditioner 1 and the installation kit 100 will be described below. FIG. 2 is an exploded view of the air conditioner 1 and the installation kit 100 which are installed in the window assembly 9.

The installation kit 100 may include an installation frame 20. The installation frame 20 may be disposed between the window frame 91 and the window 92. The installation frame 20 may be fixed to the window frame 91. The installation frame 20 may provide a space or opening in which the air conditioner 1 is disposed.

Figure 3:
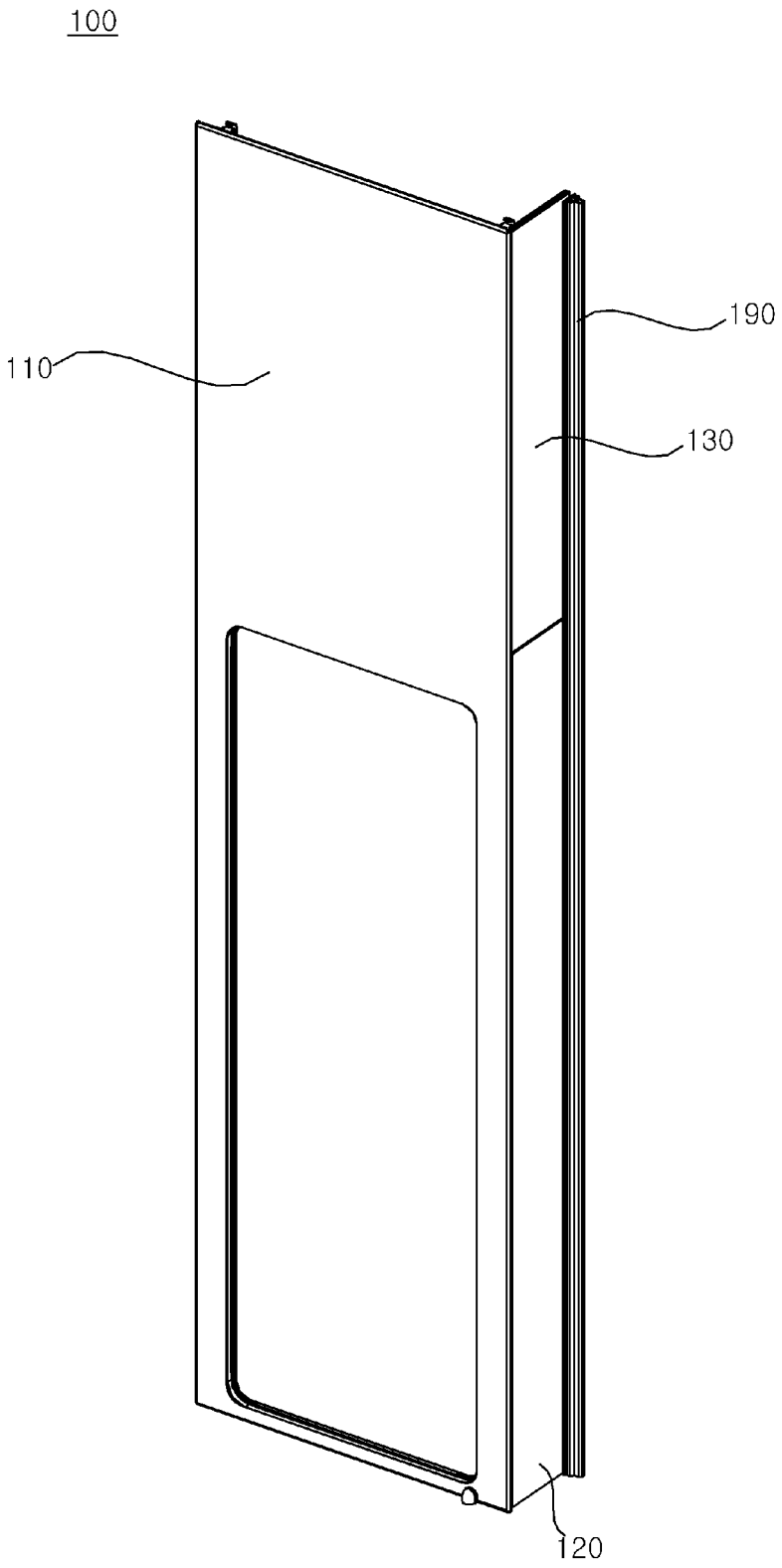
FIG. 3 is a perspective view of an installation kit according to an embodiment of the present disclosure.

The installation frame 20 may be disposed at the rear of the front panel 110 (see FIG. 3). The installation frame 20 may be installed in the window assembly 9 separately from the front panel 110. After installing the installation frame 20 and the air conditioner 1 in the window assembly 9, a user may install an assembly of the installation kit 100, including the front panel 110, at the front of the installation frame 20.

The side support 913 may include a first side support (or left side support) 913*a* and a second side support (or right side support) 913*b*. The first side support 913*a* and the second side support 913*b* may be horizontally spaced apart from each other.

The window 92 may be disposed between the first side support 913*a* and the second side support 913*b*. The window 92, disposed between the first side support 913*a* and the second side support 913*b*, may move horizontally along the upper support 911 (see FIG. 1) and the lower support 912 (see FIG. 1).

There may be a plurality of windows 92. In one example, the plurality of windows 92 may be spaced apart from each other in a front-rear direction (e.g., from the inside to the outside). In another example, the plurality of windows 92 may be spaced apart from each other in a left-right direction or in a vertical direction. The installation kit 100 may be disposed between any one of the plurality of windows 92 and the side support 913. For example, the installation frame 20 may be disposed between any one of the plurality of windows 92 and the side support 913.

In one example, the plurality of windows 92 may include a first window 921, a second window 922, a third window 923, and a fourth window 924. The first to fourth windows 921, 922, 923, and 924 may be provided in order of proximity to the indoor space (e.g., with the first window 921 being closest to the indoor space, and the fourth window 924 being farthest from the indoor space). However, the number and name of the plurality of windows 92 are not limited to the above example. For example, in the case where the window assembly 9 is a double window, the plurality of windows 92 may include the first to fourth windows 921, 922, 923, and 924. For example, if the window assembly 9 is a single window, the plurality of windows 92 may include only the first and second windows 921 and 922 and exclude the third and fourth windows 923 and 924.

Installation kits 100 and 1000 may be installed for both the single window and the double window. For example, if the window assembly 9 is a double window, the installation kit 100 to be described with reference to FIGS. 1 to 15 may be installed in the window assembly 9. For example, if the window assembly 9 is a single window, the installation kit 1000 to be described with reference to FIGS. 16 to 23 may be installed in the window assembly 9.

The window assembly 9 may provide a plurality of spaces 93 and 94 in which the air conditioner 1 may be installed. The spaces 93 and 94 may be formed between the first side support 913*a* and the second side support 913*b*. The first space 93 may be formed between the first side support 913*a* and one of the windows 92. The second space 94 may be formed between the second side support 913*b* and the window 92.

The first space 93 and the second space 94 may be horizontally spaced apart from each other. A user may selectively install the air conditioner 1 and the installation kit 100 in one of the first space 93 or the second space 94. The user may selectively install the installation kit 100 in either of the first space 93 or the second space 94 by adjusting positions of components 120, 130, 140, and 150 (see FIG. 4) of the installation kit 100, which will be described below.

Figure 4:
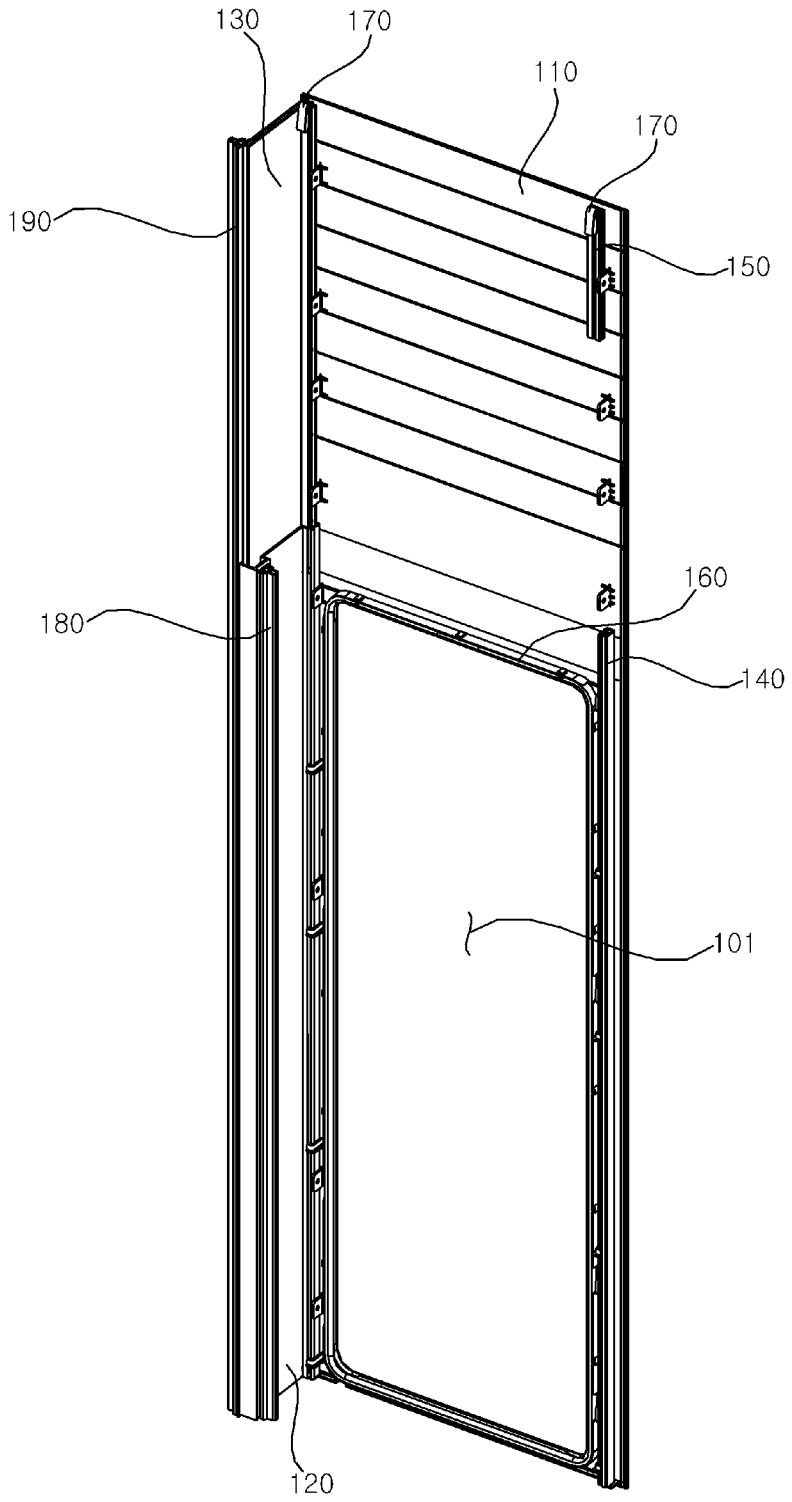
FIG. 4 is a perspective view of an installation kit according to an embodiment of the present disclosure.

Referring to FIGS. 3 and 4, the installation kit 100 will be described below. FIG. 3 is a diagram illustrating the installation kit 100 as viewed from the front. FIG. 4 is a diagram illustrating the installation kit 100 as viewed from the rear.

The installation kit 100 may include the front panel 110. The front panel 110 may be disposed to surround at least a portion of the case front end 13 (see FIG. 1) of the air conditioner 1 in the first space 93 (see FIG. 2) or the second space 94 (see FIG. 2). The installation kit 100 may have an opening 101. The case 10 of the air conditioner 1 may pass through the opening 101. The case 10 may be supported by the installation kit 100 in the opening 101. The opening 101 may be formed in the front panel 110.

The installation kit 100 may include a first side frame 120. The first side frame 120 may be detached from the front panel 110. The first side frame 120 may be disposed behind the front panel 110. The first side frame 120 may extend in an up and down or vertical direction. A vertical length of the first side frame 120 may be smaller than a vertical length of the front panel 110. The first side frame 120 may be referred to as a "side frame." The side frame may include a first side frame 120 and a second side frame 140.

The installation kit 100 may include an extension frame 130. The extension frame 130 may be detached from the front panel 110. The extension frame 130 may be disposed behind the front panel 110. The extension frame 130 may extend in the vertical direction. A vertical length of the extension frame 130 may be smaller than the vertical length of the front panel 110. The extension frame 130 may be coupled to the first side frame 120 so as to be movable in the vertical direction.

The installation kit 100 may include the second side frame 140. The second side frame 140 may be detached from the front panel 110. The second side frame 140 may be disposed behind the front panel 110. The second side frame 140 may extend in the vertical direction. A vertical length of the second side frame 140 may be smaller than the vertical length of the front panel 110. A front-to-back width of the second side frame 140 may be smaller than a front-to-back width of the first side frame 120.

The first side frame 120 and the second side frame 140 may be horizontally spaced apart from each other. The opening 101 may be formed between the first side frame 120 and the second side frame 140. When installed, the first side frame 120 may be disposed to face the window 92 (see FIG. 1), the second side frame 140 may be disposed to face the window frame 91 (see FIG. 1), and the extension frame 130 may be disposed to face the window 92 (see FIG. 1).

The installation kit 100 may include an auxiliary frame 150. The auxiliary frame 150 may be detached from the front panel 110. The auxiliary frame 150 may be disposed behind the front panel 110. The auxiliary frame 150 may extend in the vertical direction. A vertical length of the auxiliary frame 150 may be smaller than the vertical length of the second side frame 140. The auxiliary frame 150 may be positioned above and spaced apart from the second side frame 140. The auxiliary frame 150 may be horizontally spaced apart from the extension frame 130. The auxiliary frame 150 may be disposed at an upper end of the front panel 110.

The installation kit 100 may include an inner gasket 160. The inner gasket 160 may be disposed to surround at least a portion of the opening 101. The inner gasket 160 may be disposed to surround at least a portion of the case 10 (see FIG. 1). The inner gasket 160 may be disposed between at least a portion of the case 10 and at least a portion of the installation kit 100. The inner gasket 160 may seal at least a portion of a space between the case 10 (see FIG. 1) and the front panel 110.

The installation kit 100 may include at least one holder (or clip) 170. A plurality of holders 170 may be arranged to be horizontally spaced apart from each other. One or more of the holders 170 may be coupled to the extension frame 130. One or more of the holders 170 may be coupled to the auxiliary frame 150. The holders 170 may protrude upward from the extension frame 130. The holders 170 may protrude upward from the auxiliary frame 150. The holders 170 may protrude further upward than the upper end of the front panel 110. The holders 170 may be fixed to the upper support 911 of the window frame 91 (see FIG. 1). The holders 170 may serve to fix the installation kit 100 to the window frame 91.

The installation kit 100 may include a case gasket 180. The case gasket 180 may be disposed to face the opening 101. The case gasket 180 may be coupled to the first side frame 120. The case gasket 180 may be disposed between the case 10 (see FIG. 1) of the air conditioner 1 and the first side frame 120. The case gasket 180 may seal at least a portion of a space between the case 10 (see FIG. 1) and the first side frame 120.

The installation kit 100 may include a window gasket 190. The window gasket 190 may be disposed toward the outside of the installation kit 100. The window gasket 190 may be coupled to the first side frame 120. The window gasket 190 may be disposed between the window 92 (see FIG. 1) and the first side frame 120. When installed, the first side frame 120 and the extension frame 130 may face the window 92 (see FIG. 1), and the window gasket 190 may seal a space between the window 92 and the first side frame 120 and a space between the window 92 and the extension frame 130.

The second side frame 140 may face the window frame 91 (see FIG. 1). The second side frame 140 may face the side support 913 (see FIG. 1) of the window frame 91. The second side frame 140 may contact the side support 913. However, a separate gasket (not shown) may be disposed between the second side frame 140 and the side support 913.

Figure 5:
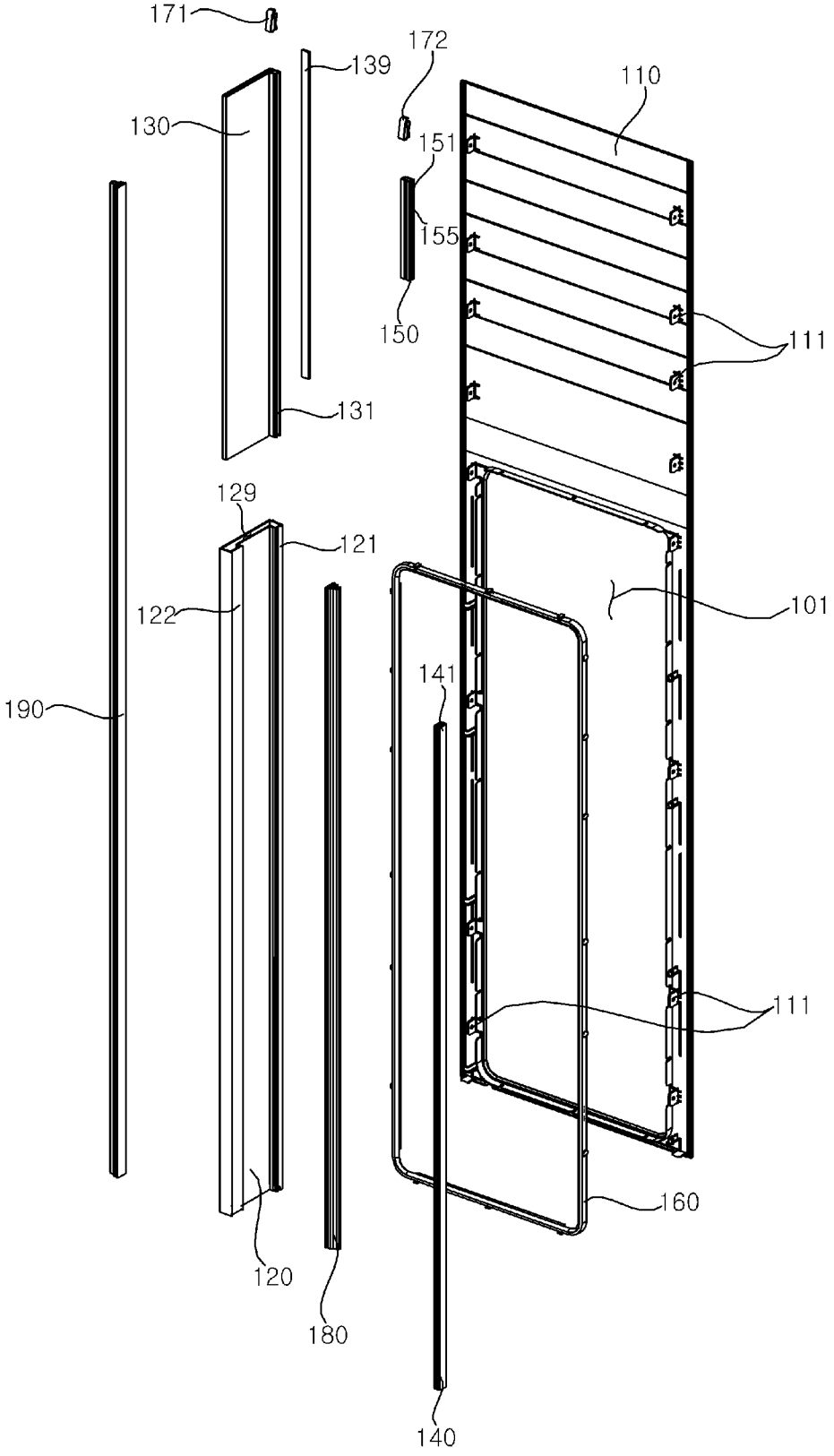
FIG. 5 is an exploded view of an installation kit according to an embodiment of the present disclosure.

Referring to FIG. 5, the installation kit 100 will be described below. FIG. 5 is an exploded view of the installation kit 100. The front panel 110 may include a coupling rib 111. A plurality of coupling ribs 111 may be arranged to be vertically spaced apart from each other. The coupling ribs 111 may protrude rearward from the front panel 110. The coupling ribs 111 may be formed on both sides of the front panel 110.

The first side frame 120 may be detached from the front panel 110. The first side frame 120 may include a first side frame coupling part (or side frame coupling wall) 121. The first side frame coupling part 121 may face the coupling ribs 111. The first side frame coupling part 121 may extend in the vertical direction. The first side frame 120 may be coupled via a predetermined fastening member (not shown) that passes through the first side frame coupling part 121 and the coupling ribs 111. However, a method of coupling the first side frame coupling part 121 and the coupling ribs 111 is not limited to the above example, such as coupling the first side frame coupling part 121 and the coupling ribs 111 using an adhesive or by welding.

The second side frame 140 may be detached from the front panel 110. The second side frame 140 may include a second side frame coupling part (or second side frame coupling wall 141. The second side frame coupling part 141 may face the coupling ribs 111. The second side frame coupling part 141 may extend in the vertical direction. The second side frame 140 may be coupled via a predetermined fastening member (not shown) that passes through the second side frame coupling part 141 and the coupling ribs 111. However, a method of coupling the second side frame coupling part 141 and the coupling ribs 111 is not limited to the above example such as coupling the second side frame coupling part 141 and the coupling ribs 111 using an adhesive or by welding.

The extension frame 130 may be detached from the front panel 110. The extension frame 130 may include an extension frame coupling part (or extension frame coupling wall) 131. The extension frame coupling part 131 may face the coupling ribs 111. The extension frame coupling part 131 may extend in the vertical direction. The extension frame 130 may be coupled via a predetermined fastening member (not shown) that passes through the extension frame coupling part 131 and the coupling ribs 111. However, a method of coupling the extension frame coupling part 131 and the coupling ribs 111 is not limited to the above example such as coupling the extension frame coupling part 131 and the coupling ribs 111 using an adhesive or by welding.

The first side frame 120 may include an extension frame insertion part (or extension frame insertion groove) 129. The extension frame 130 may be disposed in the extension frame insertion part 129 so as to be movable in the vertical direction. The extension frame 130 may move in the extension frame insertion part 129 to protrude upward from the first side frame 120.

The first side frame 120 may include a gasket coupling part (or gasket coupling wall) 122. The gasket coupling part 122 may protrude toward the opening 101. The gasket coupling part 122 may be disposed behind the first side frame coupling part 121. The case gasket 180 may be coupled to the gasket coupling part 122.

The installation kit 100 may include a finishing member (or seal) 139. The finishing member 139 may be disposed between the extension frame 130 and the front panel 110. A gap may be formed between the extension frame 130 and the front panel 110. The finishing member 139 may be disposed in the gap between the between the extension frame 130 and the front panel 110.

The auxiliary frame 150 may be detached from the front panel 110. The auxiliary frame 150 may include an auxiliary frame coupling part (or auxiliary frame coupling wall) 151. The auxiliary frame coupling part 151 may face the coupling ribs 111. The auxiliary frame coupling part 151 may extend in the vertical direction. The auxiliary frame 150 may be coupled via a predetermined fastening member (not shown) that passes through the auxiliary frame coupling part 151 and the coupling ribs 111. However, a method of coupling the auxiliary frame coupling part 151 and the coupling ribs 111 is not limited to the above example.

The holders 170 may include a first holder (or first clip) 171. The first holder 171 may be coupled to the extension frame 130. The holders 170 may include a second holder (or second clip) 172. The second holder 172 may be coupled to the auxiliary frame 150.

Figure 6:
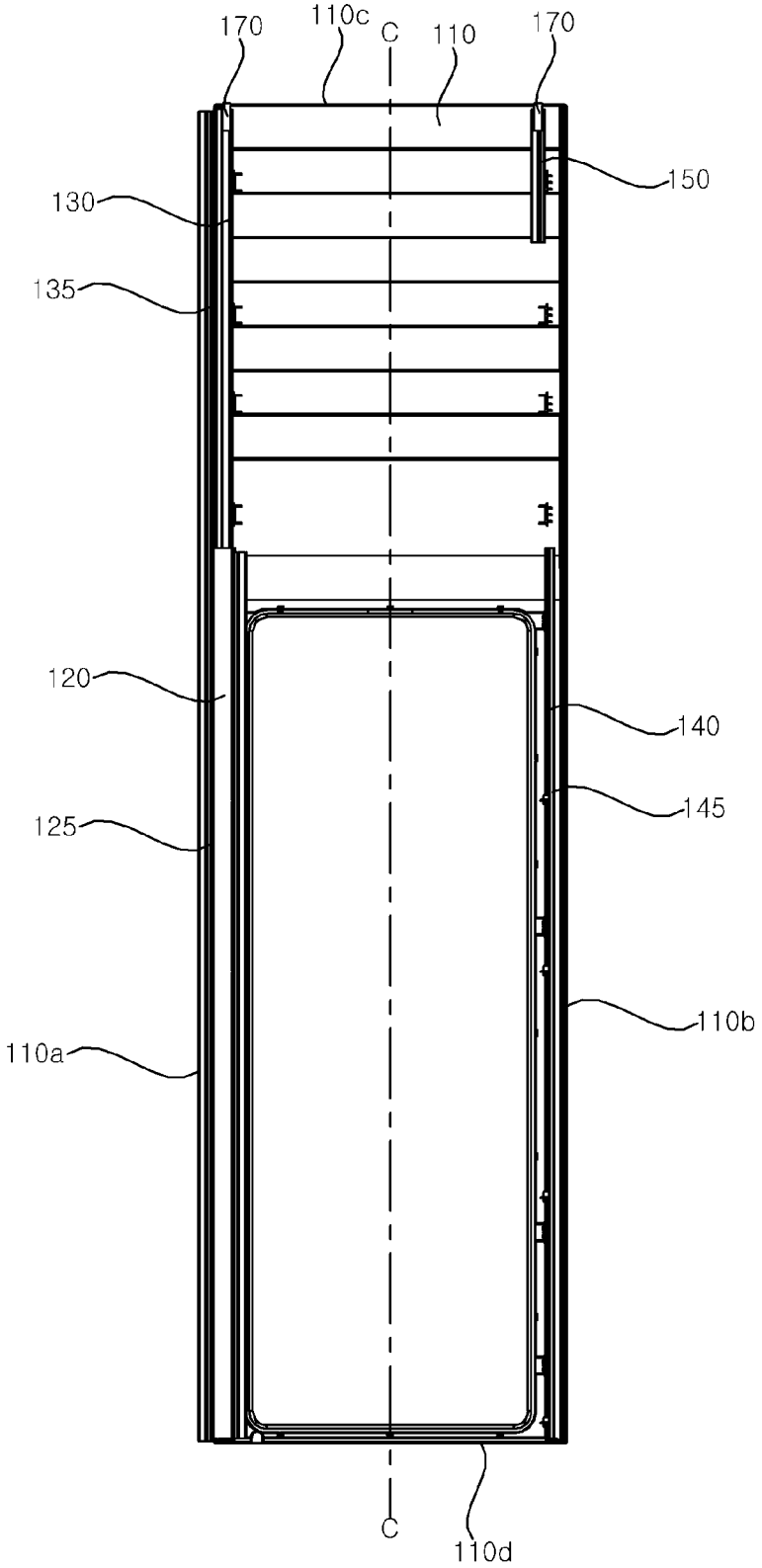
FIG. 6 is a rear view of an installation kit according to an embodiment of the present disclosure.

Referring to FIG. 6, the installation kit 100 will be described below. FIG. 6 is a diagram of the installation kit 100 as viewed from the rear. The front panel 110 may be symmetrical about a center line C. The center line C may refer to an imaginary line vertically passing through the center of the front panel 110.

The front panel 110 may include a first coupling part (or first coupling region) **110*a*. The first coupling part 110*a* may be spaced apart from one side of the opening 101. The first coupling part 110*a*** may extend in the vertical direction.

The front panel 110 may include a second coupling part (or second coupling region) **110*b*. The second coupling part 110*b* may be spaced apart from one side of the opening 101. The second coupling part 110*b*** may extend in the vertical direction.

The first coupling part **110*a* and the second coupling part 110*b* may be horizontally spaced apart from each other. The first coupling part 110*a* and the second coupling part 110*b* may be symmetrical about the opening 101**.

The first side frame 120 may be disposed on one of the first coupling part **110*a* or the second coupling part 110*b*. The second side frame 140 may be disposed on another one of the first coupling part 110*a* or the second coupling part 110*b*. The extension frame 130 may be disposed on one of the first coupling part 110*a* or the second coupling part 110*b*. For example, the extension frame 130 may be disposed on the one of the first coupling part 110*a* or the second coupling part 110*b* at which the first side frame 120** is installed.

The first side frame 120 may include a first outer surface 125. The first outer surface 125 may refer to one surface of the first side frame 120 that faces the outside of the installation kit 100. The first outer surface 125 may face the window 92 (see FIG. 1). The first outer surface 125 may be a surface opposite to a surface on which the first side frame coupling part 121 (see FIG. 5) is formed.

The second side frame 140 may include a second outer surface 145. The second outer surface 145 may refer to one surface of the second side frame 140 that faces the outside of the installation kit 100. The second outer surface 145 may face the window frame 91 (see FIG. 1). The second outer surface 145 may be a surface opposite to a surface on which the second side frame coupling part 141 (see FIG. 5) is formed.

The extension frame 130 may include an extension frame outer surface 135. The extension frame outer surface 135 may refer to one surface of the extension frame 130 that faces the outside of the installation kit 100. The extension frame outer surface 135 may face the window 92 (see FIG. 1). The extension frame outer surface 135 may be a surface opposite to a surface on which the extension frame coupling part 131 (see FIG. 5) is formed.

Based on the embodiment illustrated in FIG. 6, when the first side frame 120 is coupled to the first coupling part 110*a*, the first outer surface 125 may face leftward. In another example, when the first side frame 120 is coupled to the second coupling part 110*b*, the first outer surface 125 may face rightward.

Based on the embodiment illustrated in FIG. 6, when the second side frame 140 is coupled to the second coupling part 110*b*, the second outer surface 145 may face rightward. In another example, when the second side frame 140 is coupled to the first coupling part 110*a*, the second outer surface 145 may face leftward.

Based on the embodiment illustrated in FIG. 6, when the extension frame 130 is coupled to the first coupling part 110*a*, the extension frame outer surface 135 may face leftward. In another example, when the extension frame 130 is coupled to the second coupling part 110*b*, the extension frame outer surface 135 may face rightward.

The front panel 110 may include a panel upper end 110*c*. The panel upper end 110*c* may be spaced above the opening 101. The extension frame 130 may extend toward the panel upper end 110*c*. An upper end of the extension frame 130 may be disposed at the panel upper end 110*c*.

The auxiliary frame 150 may extend vertically toward the panel upper end 110*c*. An upper end of the auxiliary frame 150 may be disposed at the panel upper end 110*c*.

The holders 170 may protrude upward from the panel upper end 110*c*. The holders 170 may protrude upward from each of the extension frame 130 and the auxiliary frame 150.

The front panel 110 may include a panel lower end 110*d*. The panel lower end 110*d* may be spaced below the opening 101. A lower end of the first side frame 120 may be disposed at the panel lower end 110*d*. A lower end of the second side frame 140 may be disposed at the panel lower end 110*d*.

Figure 7:
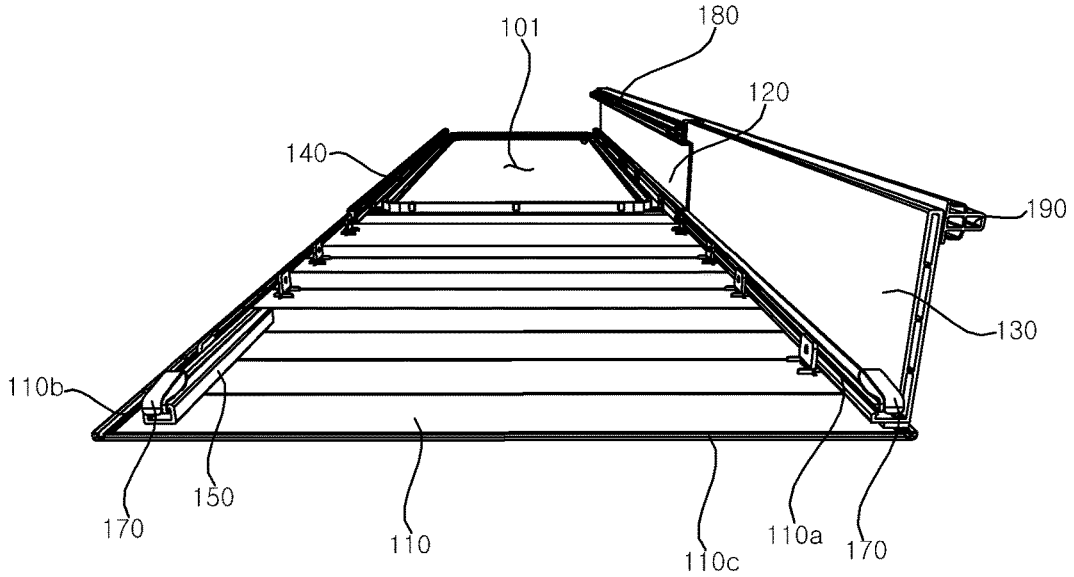
FIG. 7 is a perspective view of an installation kit according to an embodiment of the present disclosure.
Figure 8:
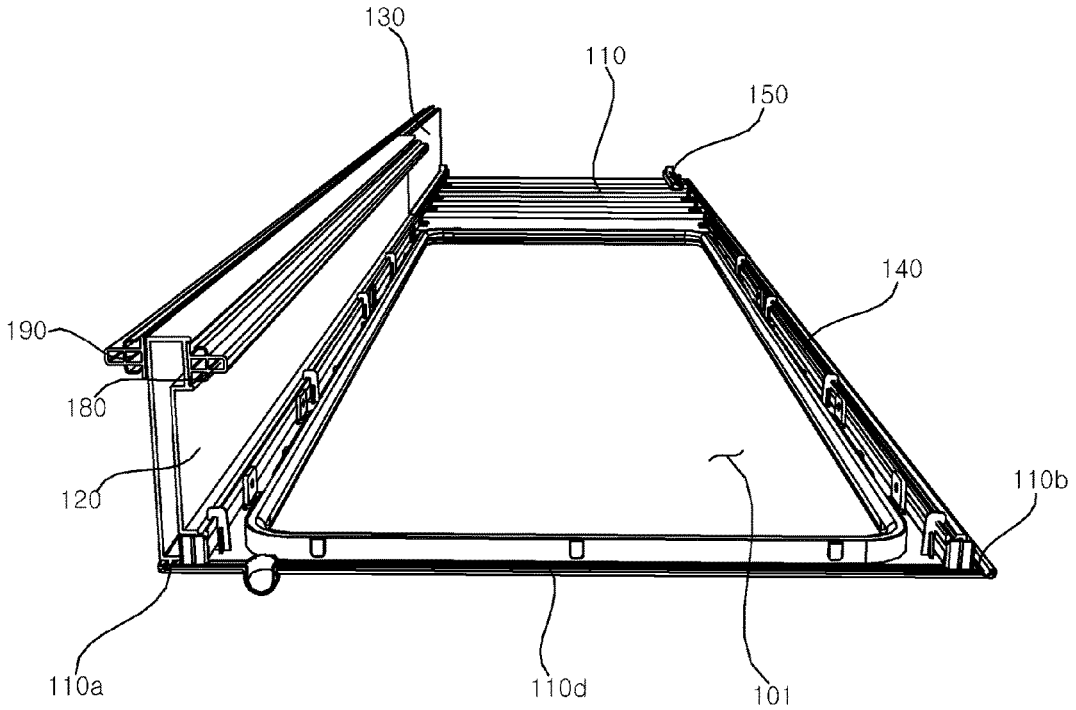
FIG. 8 is a perspective view of an installation kit according to an embodiment of the present disclosure.

Referring to FIGS. 7 and 8, the installation kit 100 will be described below. FIG. 7 is a diagram illustrating the installation kit 100 as viewed obliquely from top to bottom. FIG. 8 is a diagram illustrating the installation kit 100 as viewed obliquely from bottom to top.

With respect to the opening 101, the first coupling part 110*a* may be disposed on one side of the opening 101, and the second coupling part 110*b* may be disposed on another side of the opening 101. The opening 101 may be disposed between the first side frame 120 and the second side frame 140. The extension frame 130 may be disposed on an upper side of the first side frame 120. The auxiliary frame 150 may be spaced above the second side frame 140.

The case gasket 180 may be coupled to the first side frame 120. A vertical height of the case gasket 180 relative to front panel 110 may correspond to a vertical height or extension of the first side frame 120 from front panel 110.

The window gasket 190 may be coupled to the first side frame 120 and the extension frame 130. A vertical height of the window gasket 190 relative to front panel 110 may correspond to a vertical height of the front panel 110 from front panel 110.

Figure 9:
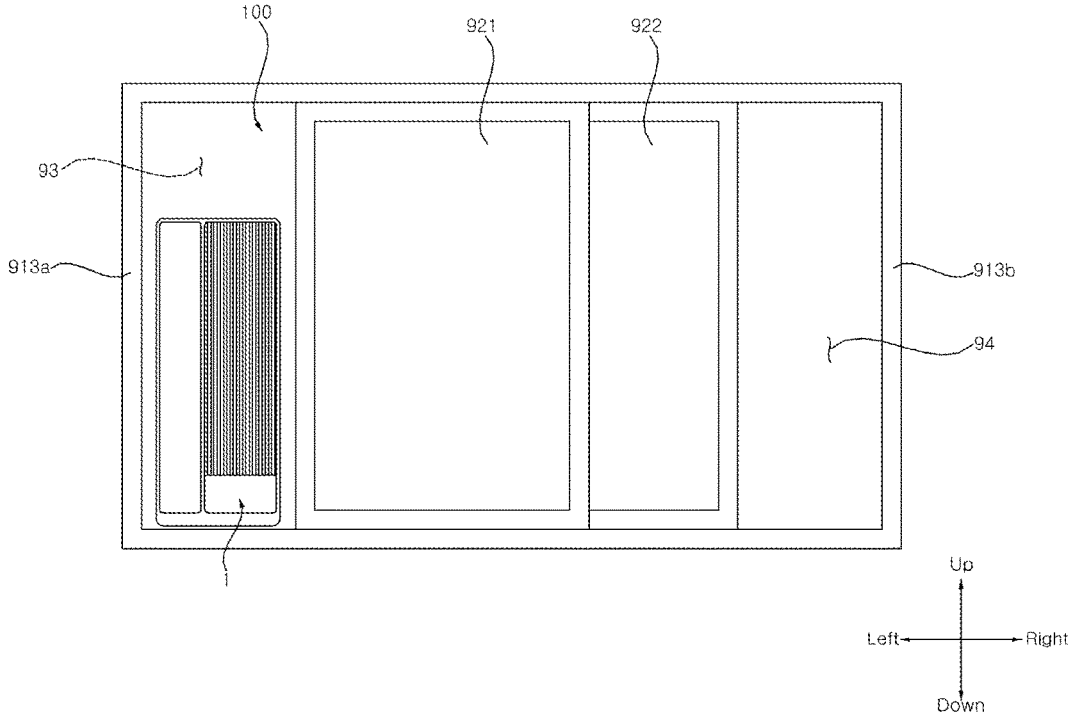
FIG. 9 is a view illustrating a first example of installation of an air conditioner according to an embodiment of the present disclosure.

Referring to FIG. 9, the air conditioner 1 and the installation kit 100 will be described below. FIG. 9 is a diagram illustrating the air conditioner 1 and the installation kit 100 which are installed in the first space 93. As previously described, the air conditioner 1 may be selectively disposed in the first space 93 or the second space 94. Similarly, the installation kit 100 may be selectively disposed in the first space 93 or the second space 94. When installed in the first space 93, the air conditioner 1 and the installation kit 100 may be disposed between the first side support 913*a* and the window 92.

Figure 10:
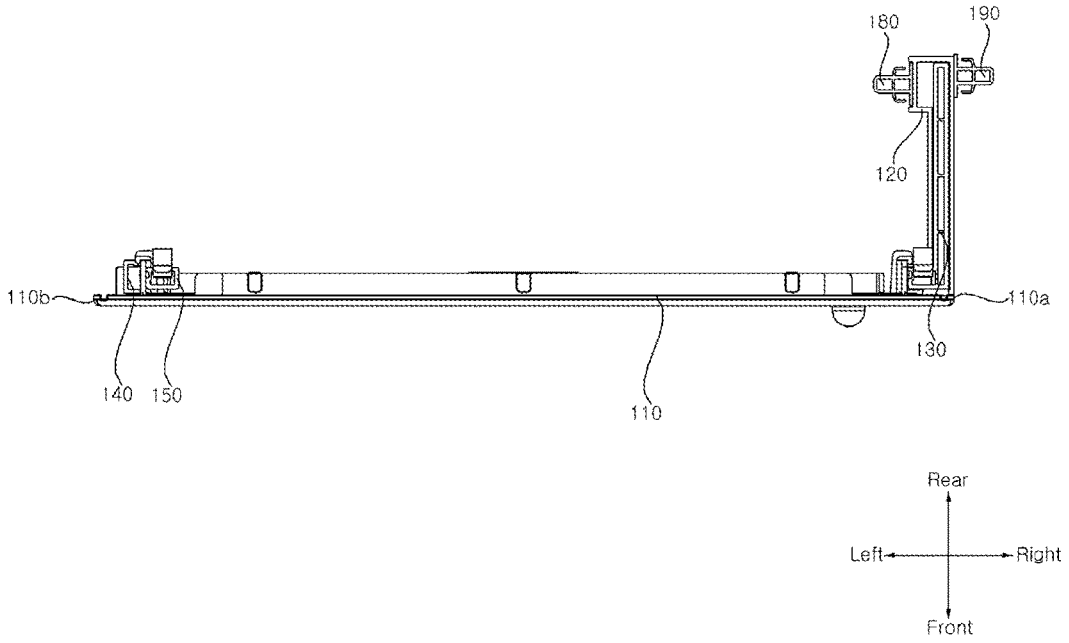
FIG. 10 is a top view of an installation kit according to an embodiment of the present disclosure.

Referring to FIG. 10, the installation kit 100 will be described below. FIG. 10 is a diagram illustrating the installation kit 100 as viewed from top to bottom, when the installation kit 100 is installed in the first space 93, as illustrated in FIG. 9.

The first side frame 120 and the extension frame 130 may be coupled to the first coupling part 110*a* of the front panel 110. The first side frame 120 and the extension frame 130 may be disposed to face at least one of the windows 921 and 922. The case gasket 180 and the window gasket 190 may be disposed on the first coupling part 110*a*. The second side frame 140 and the auxiliary frame 150 may be coupled to the second coupling part 110*b*. The second side frame 140 and the auxiliary frame 150 may face a window frame 913*a*.

Figure 11:
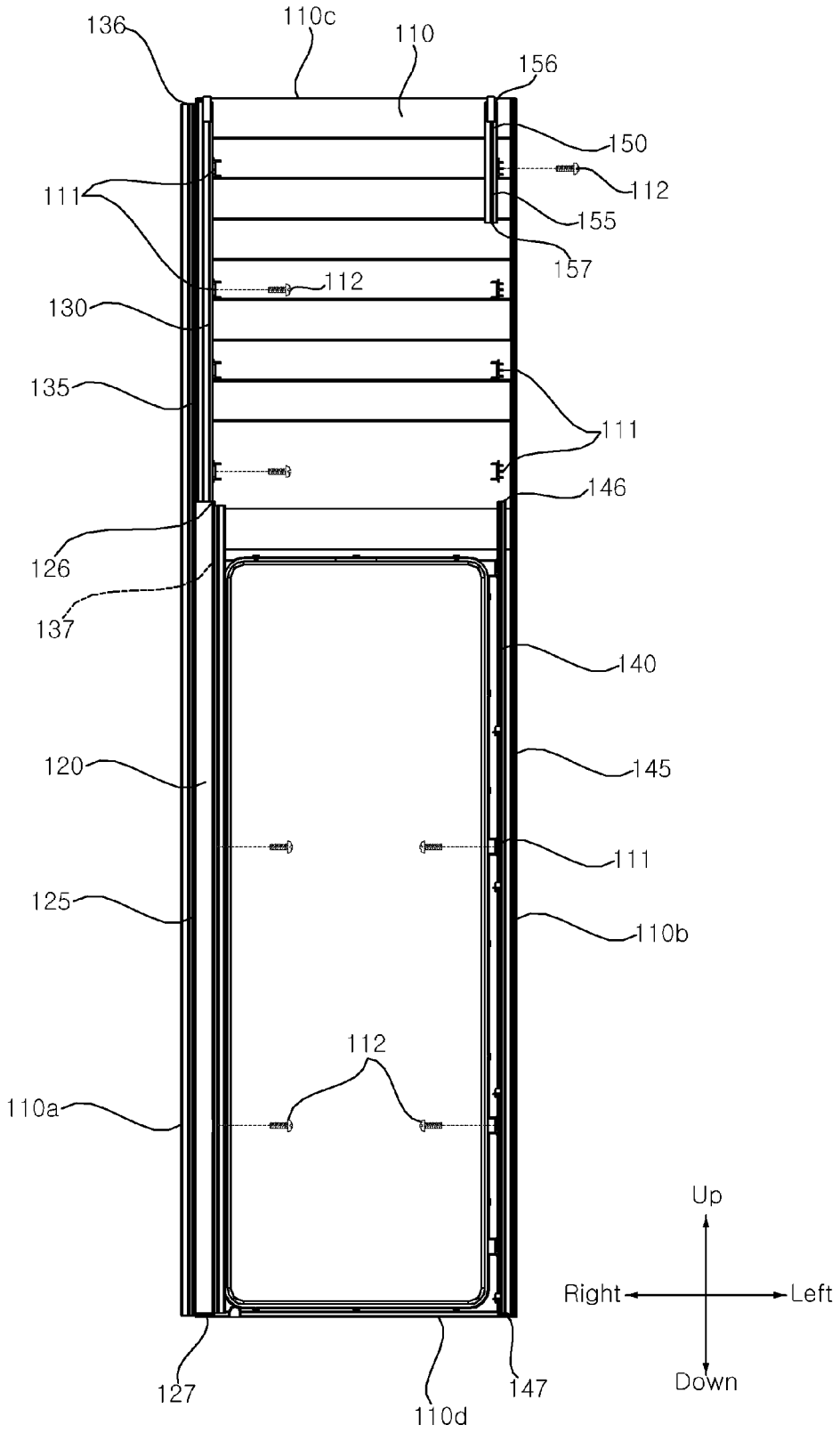
FIG. 11 is a rear view of an installation kit according to an embodiment of the present disclosure.

Referring to FIG. 11, the installation kit 100 will be described below. FIG. 11 is a diagram illustrating the installation kit 100 as viewed from the rear, when the installation kit 100 is installed in the first space 93, as illustrated in FIG. 9.

The first side frame 120 may include a first end 126. The first end 126 may form one end surface of the first side frame 120. The first side frame 120 may include a second end 127. The second end 127 may form another end surface of the first side frame 120. The first side frame 120 may extend from the first end 126 toward the second end 127.

The second side frame 140 may include a first side end 146. The first side end 146 may form one end surface of the second side frame 140. The second side frame 140 may include a second side end 147. The second side end 147 may form another end surface of the second side frame 140. The second side frame 140 may extend from the first side end 146 toward the second side end 147.

The extension frame 130 may include a first extension frame end 136. The first extension frame end 136 may form one end surface of the extension frame 130. The extension frame 130 may include a second extension frame end 137. The second extension frame end 137 may form another end surface of the extension frame 130. The extension frame 130 may extend from the first extension frame end 136 toward the second extension frame end 137.

The auxiliary frame 150 may include a first auxiliary frame end 156. The first auxiliary frame end 156 may form one end surface of the auxiliary frame 150. The auxiliary frame 150 may include a second auxiliary frame end 157. The second auxiliary frame end 157 may form another end surface of the auxiliary frame 150. The auxiliary frame 150 may extend from the first auxiliary frame end 156 to the second auxiliary frame end 157.

The auxiliary frame 150 may include an auxiliary frame outer surface 155. The auxiliary frame outer surface 155 may face the coupling ribs 111.

The installation kit 100 may include a fastening member (or fastener) 112. A plurality of fastening members 112 may be provided to correspond to the plurality of coupling ribs 111.

When the installation kit 100 is installed in the first space 93 as illustrated in FIG. 9, the first end 126 may be disposed above the second end 127. The first end 126 may be disposed above the opening 101. The second end 127 may be disposed at the panel lower end 110*d*. When the installation kit 100 is installed as illustrated in FIG. 9, the first outer surface 125 may face at least one of the windows 921 and 922.

When the installation kit 100 is installed in the first space 93 as illustrated in FIG. 9, the first side frame coupling part 121 (see FIG. 5) may face the coupling ribs 111. The fastening members 112 pass through the first side frame coupling part 121 and the coupling ribs 111 so that the first side frame 120 may be coupled to the front panel 110.

When the installation kit 100 is installed in the first space 93 as illustrated in FIG. 9, the first side end 146 may be disposed above the second side end 147. The first side end 146 may be disposed above the opening 101. The second side end 147 may be disposed at the panel lower end 110*d*. When the installation kit 100 is installed as illustrated in FIG. 9, the second outer surface 145 may face the window frame 913*a*.

When the installation kit 100 is installed in the first space 93 as illustrated in FIG. 9, the second side frame coupling part 141 (see FIG. 5) may face the coupling ribs 111. The fastening members 112 pass through the second side frame coupling part 141 and the coupling ribs 111 so that the second side frame 140 may be coupled to the front panel 110.

When the installation kit 100 is installed in the first space 93 as illustrated in FIG. 9, the first extension frame end 136 may be disposed above the second extension frame end 137. The first extension frame end 136 may be disposed at the panel upper end 110*c*. The second extension frame end 137 may be disposed inside the first side frame 120. The holders 170 may be coupled to the first extension frame end 136. When the installation kit 100 is installed as illustrated in FIG. 9, the extension frame outer surface 135 may face the windows 921 and 922.

When the installation kit 100 is installed in the first space 93 as illustrated in FIG. 9, the extension frame coupling part 131 (see FIG. 5) may face the coupling ribs 111. The fastening members 112 pass through the extension frame coupling part 131 and the coupling ribs 111 so that the extension frame 130 may be coupled to the front panel 110.

When the installation kit 100 is installed in the first space 93 as illustrated in FIG. 9, the first auxiliary frame end 156 may be disposed above the second auxiliary frame end 157. The first auxiliary frame end 156 may be disposed at the panel upper end 110*c*. The second auxiliary frame end 157 may be spaced above the second side frame 140. The holders 170 may be coupled to the first auxiliary frame end 156. When the installation kit 100 is installed as illustrated in FIG. 9, the auxiliary frame outer surface 155 may face the window frame 913*a*.

When the installation kit 100 is installed in the first space 93 as illustrated in FIG. 9, the auxiliary frame coupling part 151 (see FIG. 5) may face the coupling ribs 111. The fastening members 112 pass through the auxiliary frame coupling part 151 and the coupling ribs 111 so that the auxiliary frame 150 may be coupled to the front panel 110.

Figure 12:
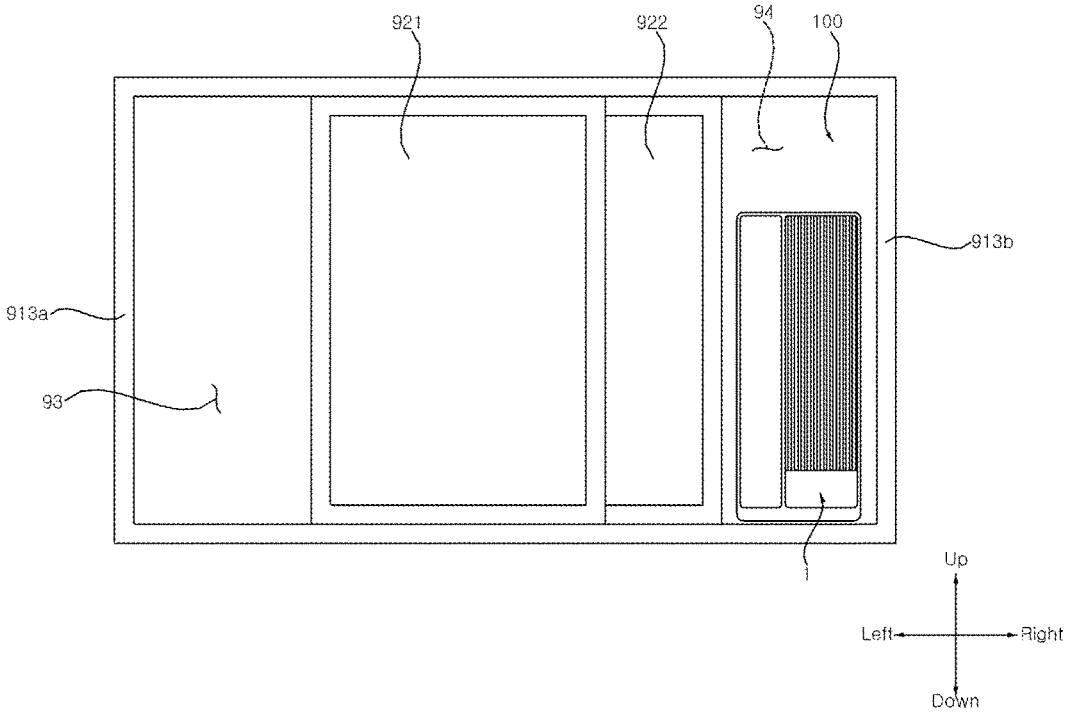
FIG. 12 is a view illustrating a second example of installation of an air conditioner according to an embodiment of the present disclosure.

Referring to FIG. 12, the air conditioner 1 and the installation kit 100 will be described below. FIG. 12 is a diagram illustrating the air conditioner 1 and the installation kit 100 which are installed in the second space 94. As previously described, the air conditioner 1 may be selectively disposed in the first space 93 or the second space 94, and the installation kit 100 may be selectively disposed in the first space 93 or the second space 94. When the air conditioner 1 and the installation kit 100 are installed in the second space 94, the air conditioner 1 and the installation kit 100 may be disposed between the second side support 913*b* and the window 92.

Figure 13:
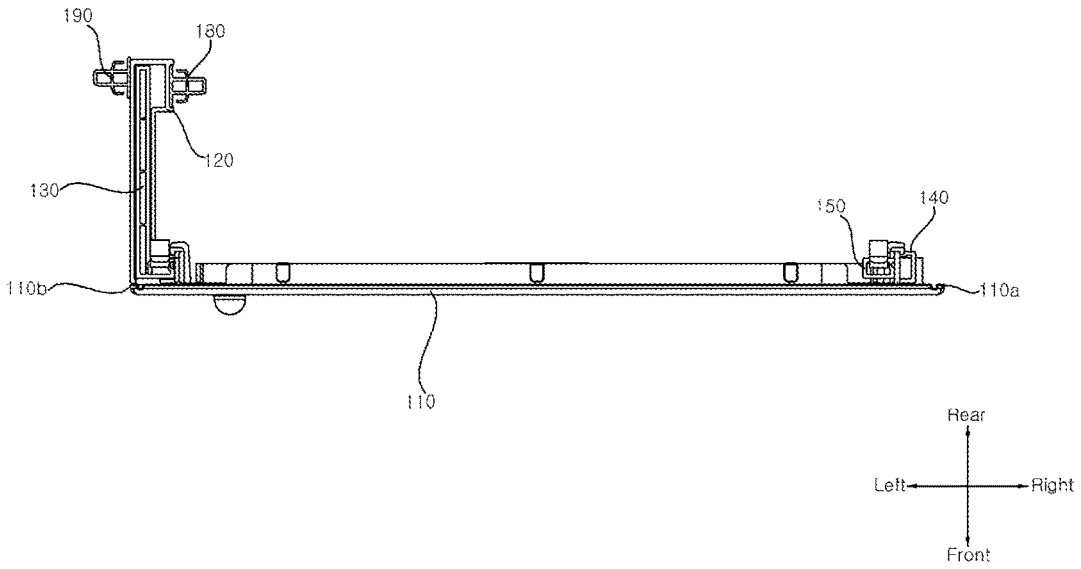
FIG. 13 is a top view of an installation kit according to an embodiment of the present disclosure.

Referring to FIG. 13, the installation kit 100 will be described below. FIG. 13 is a diagram illustrating the installation kit 100 as viewed from top to bottom, when the installation kit 100 is installed in the second space 94, as illustrated in FIG. 12. The first side frame 120 and the extension frame 130 may be coupled to the second coupling part 110*b* of the front panel 110. The first side frame 120 and the extension frame 130 may be disposed to face at least one of the windows 921 and 922.

The case gasket 180 and the window gasket 190 may be disposed on the second coupling part 110*b*. The second side frame 140 and the auxiliary frame 150 may be coupled to the first coupling part 110*a*. The second side frame 140 and the auxiliary frame 150 may face the window frame 913*a*.

Figure 14:
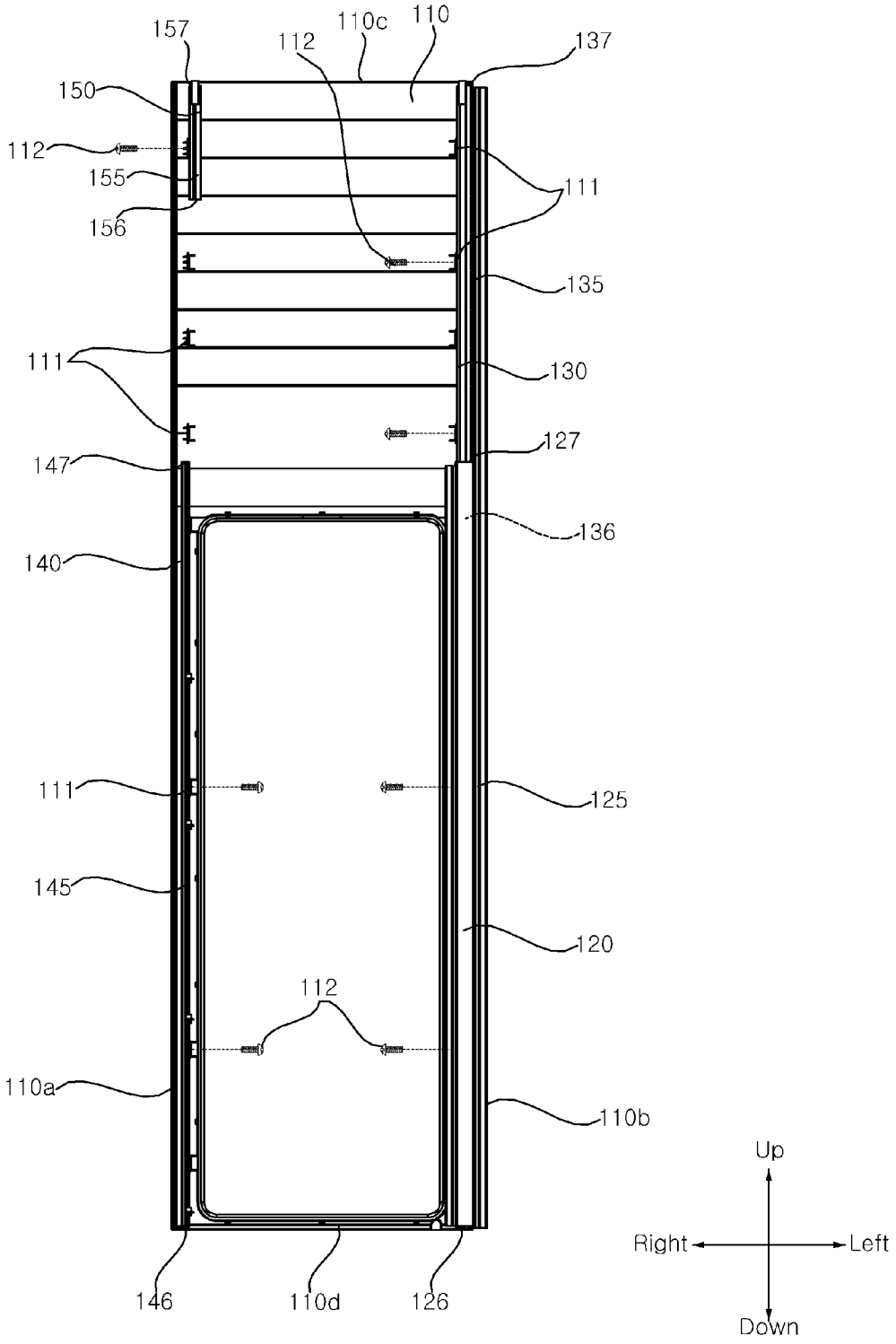
FIG. 14 is a rear view of an installation kit according to an embodiment of the present disclosure.

Referring to FIG. 14, the installation kit 100 will be described below. FIG. 14 is a diagram illustrating the installation kit 100 as viewed from the rear, when the installation kit 100 is installed in the second space 94, as illustrated in FIG. 12.

When the installation kit 100 is installed in the second space 94 as illustrated in FIG. 12, the second end 127 may be disposed above the first end 126. The second end 127 may be disposed above the opening 101. The first end 126 may be disposed at the panel lower end 110*d*.

When the installation kit 100 is installed in the second space 94 as illustrated in FIG. 12, the first outer surface 125 may face at least one of the windows 921 and 922. When the installation kit 100 is installed in the second space 94 as illustrated in FIG. 12, the first side frame coupling part 121 (see FIG. 5) may face the coupling ribs 111. The fastening members 112 pass through the first side frame coupling part 121 and the coupling ribs 111 so that the first side frame 120 may be coupled to the front panel 110.

When the installation kit 100 is installed in the second space 94 as illustrated in FIG. 12, the second side end 147 may be disposed above the first side end 146. The second side end 147 may be disposed above the opening 101. The first side end 146 may be disposed at the panel lower end 110*d*. Furthermore, when the installation kit 100 is installed in the second space 94 as illustrated in FIG. 12, the second outer surface 145 may face a window frame 913*b*.

When the installation kit 100 is installed in the second space 94 as illustrated in FIG. 12, the second side frame coupling part 141 (see FIG. 5) may face the coupling ribs 111. The fastening members 112 pass through the second side frame coupling part 141 and the coupling ribs 111 so that the second side frame 140 may be coupled to the front panel 110.

When the installation kit 100 is installed in the second space 94 as illustrated in FIG. 12, the second extension frame end 137 may be disposed above the first extension frame end 136. The second extension frame end 137 may be disposed at the panel upper end 110*c*. The first extension frame end 136 may be disposed inside the first side frame 120. The holders 170 may be coupled to the second extension frame end 137. Similarly, when the installation kit 100 is installed in the second space 94 as illustrated in FIG. 12, the extension frame outer surface 135 may face at least one of the windows 921 and 922.

When the installation kit 100 is installed in the second space 94 as illustrated in FIG. 12, the extension frame coupling part 131 (see FIG. 5) may face the coupling ribs 111. The fastening members 112 pass through the extension frame coupling part 131 and the coupling ribs 111 so that the extension frame 130 may be coupled to the front panel 110.

When the installation kit 100 is installed in the second space 94 as illustrated in FIG. 12, the second auxiliary frame end 157 may be disposed above the first auxiliary frame end 156. The second auxiliary frame end 157 may be disposed at the panel upper end 110*c*. The first auxiliary frame end 156 may be spaced above the second side frame 140. The holders 170 may be coupled to the second auxiliary frame end 157. Similarly, when the installation kit 100 is installed in the second space 94 as illustrated in FIG. 12, the auxiliary frame outer surface 155 may face the window frame 913*b*.

When the installation kit 100 is installed in the second space 94 as illustrated in FIG. 12, the auxiliary frame coupling part 151 (see FIG. 5) may face the coupling ribs 111. The fastening members 112 pass through the auxiliary frame coupling part 151 and the coupling ribs 111 so that the auxiliary frame 150 may be coupled to the front panel 110.

Upon comparison of FIGS. 11 and 14, the upper end and the lower end of each of the first side frame 120, the second side frame 140, the extension frame 130, and the auxiliary frame 150 may be opposite each other.

For example, the first side frame 120 is coupled to the first coupling part 110*a* and the first end 126 is disposed above the second end 127 in FIG. 11, whereas in FIG. 14, the first side frame 120 is coupled to the second coupling part 110*b* and the first end 126 is disposed below the second end 127. Accordingly, by coupling the first side frame 120 to the second coupling part 110*b* by simply turning the first side frame 120 upside down, a user may change an installation location of the installation kit 100 from the first space 93 to the second space 94.

For example, the second side frame 140 is coupled to the second coupling part 110*b* and the first side end 146 is disposed above the second side end 147 in FIG. 11, whereas in FIG. 14, the second side frame 140 is coupled to the first coupling part 110*a* and the first side end 146 is disposed below the second side end 147. Accordingly, by coupling the second side frame 140 to the first coupling part 110*a* by simply turning the second side frame 140 upside down, a user may change an installation location of the installation kit 100 from the first space 93 to the second space 94.

For example, the extension frame 130 may be coupled to the first coupling part 110*a* and the first extension frame end 136 may be disposed above the second extension frame end 137 when the installation kit is installed in the first space 93 as shown in FIG. 11, whereas when the installation kit is installed in the second space 94 as shown in FIG. 14, the extension frame 130 is coupled to the second coupling part 110*b* and the first extension frame end 136 is disposed below the second extension frame end 137. Accordingly, by coupling the extension frame 130 to the second coupling part 110*b* by simply turning the extension frame 130 upside down, a user may change an installation location of the installation kit 100 from the first space 93 to the second space 94.

For example, the auxiliary frame 150 is coupled to the second coupling part 110*b* and the first auxiliary frame end 156 is disposed above the second auxiliary frame end 157 when the installation kit is installed in the first space 93 as shown in FIG. 11, whereas when the installation kit is installed in the second space 94 as shown in FIG. 14, the auxiliary frame 150 is coupled to the first coupling part 110*a* and the first auxiliary frame end 156 is disposed below the second auxiliary frame end 157. Accordingly, by coupling the auxiliary frame 150 to the first coupling part 110*a* by simply turning the auxiliary frame 150 upside down, a user may change an installation location of the installation kit 100 from the first space 93 to the second space 94.

Figure 15:
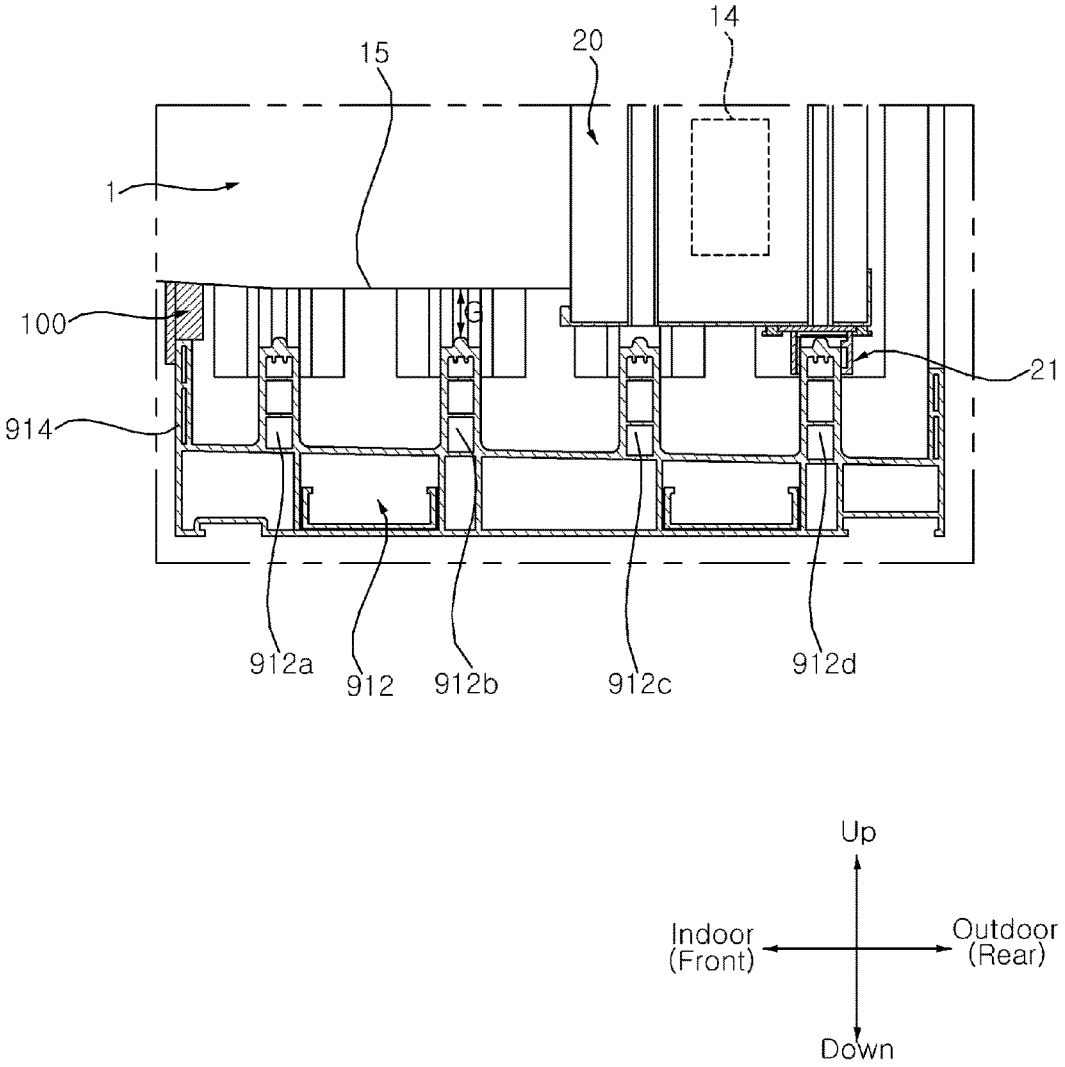
FIG. 15 is a cross-sectional view of a portion of a window-mounted air conditioner according to an embodiment of the present disclosure.

Referring to FIG. 15, the air conditioner 1 and the installation kit 100 will be described below. FIG. 15 is a diagram illustrating a lower portion of a top-down cross-sectional view of the air conditioner 1 and the installation kit 100 which are installed in the window assembly 9.

A lower support 912 may include a plurality of lower rails 912*a*, 912*b*, 912*c*, and 912*d*. The plurality of lower rails 912*a*, 912*b*, 912*c*, and 912*d* may be spaced apart from each other in a front-rear direction. The plurality of windows 921, 922, 923, and 924 (see FIG. 2) may move horizontally along the plurality of lower rails 912*a*, 912*b*, 912*c*, and 912*d*.

An installation frame 20 may be coupled to any one of the plurality of lower rails 912*a*, 912*b*, 912*c*, and 912*d*. The installation frame 20 may include a supporter 21 coupled to any one of the plurality of lower rails 912*a*, 912*b*, 912*c*, and 912*d*. The installation frame 20 may be disposed between the air conditioner 1 and the lower rails 912*a*, 912*b*, 912*c*, and 912*d*.

The air conditioner 1 may include a lower end portion 15 of the case. The lower end portion 15 of the case may form a lower surface of the case 10. The lower end portion 15 of the case may be spaced above at least one of the lower rails 912*a*, 912*b*, 912*c*, and 912*d*. A gap G may be formed between the lower end portion 15 of the case and one or more of the lower rails 912*a*, 912*b*, 912*c*, and 912*d*.

The air conditioner 1 may include a compressor 14 for circulating refrigerant. The compressor 14 may be disposed in the case 10. The air conditioner 1 may include a heat pump device having the compressor 14. The heat pump device may be disposed in the case 10.

The compressor 14 may be disposed at the rear of the installation kit 100. For example, the compressor 14 may be disposed inside the installation frame 20. The compressor 14 may be disposed between the installation kit 100 and the supporter 21.

The installation kit 100 may be coupled to the window frame front end 914. The installation kit 100 may be disposed in front of the installation frame 20 and the compressor 14.

The installation kit 100 may reduce vibration and noise generated by the air conditioner 1. Particularly, the installation kit 100 may reduce noise and vibration generated by the compressor 14 in the case 10. The noise and vibration generated by the compressor 14 may be transmitted to the indoor space through the supporter 21 and the lower support 912 acting as a medium. The installation kit 100 is disposed between the case 10 and the window frame 91 in front of the compressor 14, thereby reducing the noise and vibration transmitted to the indoor space from the rear side of the installation kit 100.

Figure 16:
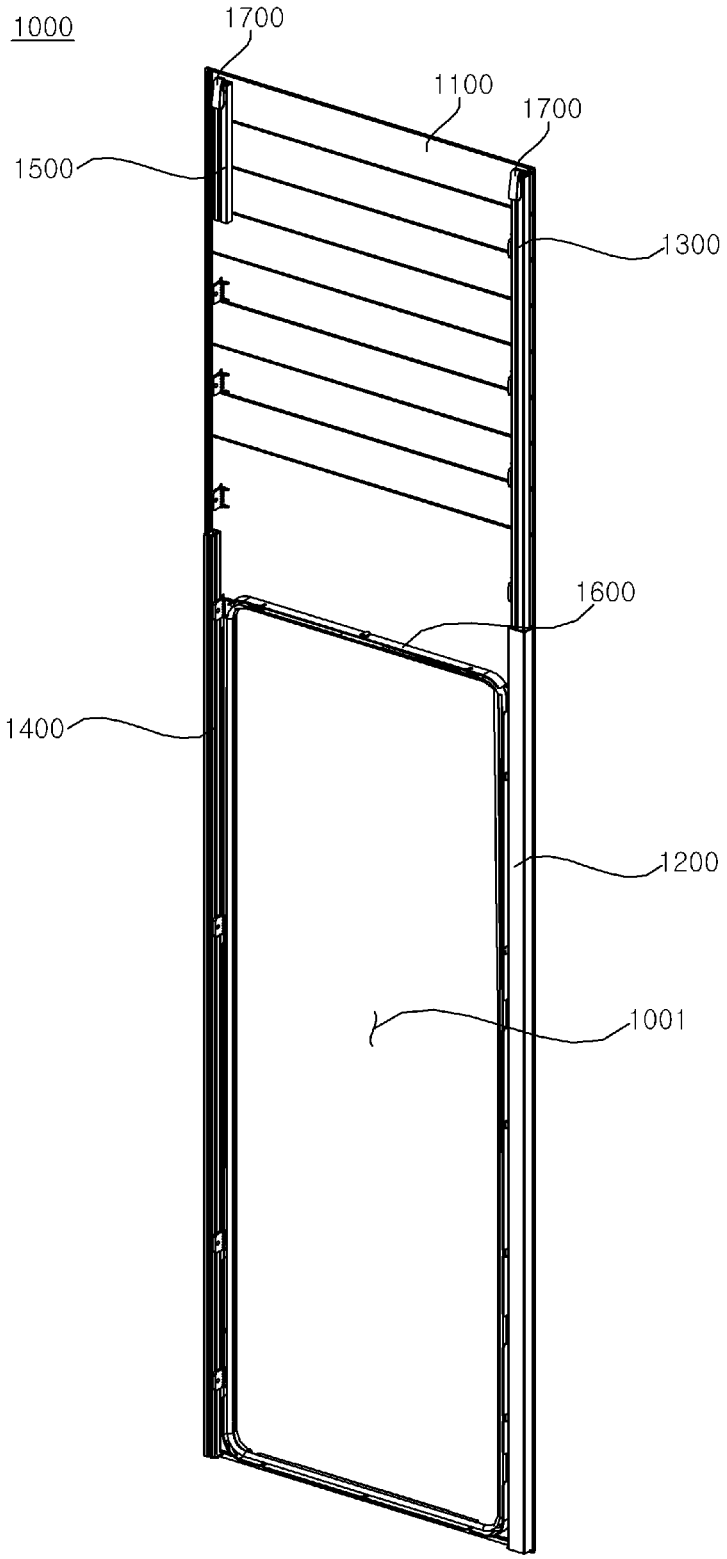
FIG. 16 is a perspective view of an installation kit according to an embodiment of the present disclosure.

Referring to FIG. 16, the installation kit 1000 will be described below. FIG. 16 is a diagram illustrating the installation kit 1000 as viewed from the rear, according to an embodiment of the present disclosure. For example, as previously described, the installation kit 100 described above with reference to FIGS. 1 to 15 may be installed in a double window. The installation kit 1000 which will be described below with reference to FIGS. 16 to 23 may be installed in a single window.

The installation kit 100 described above with reference to FIGS. 1 to 15 may be referred to as a "first installation kit 100." The installation kit 1000 to be described below with reference to FIGS. 16 to 23 may be referred to as a "second installation kit 1000. The above description of components of the first installation kit 100 described above with reference to FIGS. 1 to 15 may also apply to corresponding components of the second installation kit 1000, which will be described below with reference to FIGS. 16 to 23.

The installation kit 1000 may include a front panel 1100. It should be appreciated that that the above description of the front panel 110 described with reference to FIGS. 1 to 15 may also apply to a front panel 1100 in the following description of the installation kit 1000 with reference to FIGS. 16 to 23. For example, the front panel 110 of the installation kit 100 and the front panel 1100 of the installation kit 1000 may have a similar structure and shape.

A front-to-back width of a first side frame 1200 of the second installation kit 1000 may be smaller than a front-to-back width of the first side frame 120 of the first installation kit 100. Similarly, a front-to-back width of an extension frame 1300 of the second installation kit 1000 may be smaller than a front-to-back width of the extension frame 130 of the first installation kit 100. In one example, the extension frame 1300 of the second installation kit 1000 may have a similar structure and shape as the second side frame 140 of the first installation kit 100. For example, the second side frame 140 of the first installation kit 100 may be used as the extension frame 1300 of the second installation kit 1000. However, in using the same frame for different installation kits 100; 1000, a surface in contact with the front panel 110 when the second side frame 140 of the first installation kit 100 is used may be different from a surface in contact with the front panel 1100 when the extension frame 1300 of the second installation kit 1000 is used.

A second side frame 1400 of the second installation kit 1000 may have a similar structure and shape as the second side frame 140 of the first installation kit 100. For example, the second side frame 140 of the first installation kit 100 may be used as the second side frame 1400 of the second installation kit 1000. However, in using the same frame for different installation kits 100; 1000, a surface in contact with the front panel 110 when the second side frame 140 of the first installation kit 100 is used may be different from a surface in contact with the front panel 1100 when the second side frame 1400 of the second installation kit 1000 is used.

An auxiliary frame 1500 of the second installation kit 1000 may have a similar structure and shape as the auxiliary frame 150 of the first installation kit 100. For example, the auxiliary frame 150 of the first installation kit 100 may be used as the auxiliary frame 1500 of the second installation kit 1000. However, in using the same frame for different installation kits 100; 1000, a surface in contact with the front panel 110 when the auxiliary frame 150 of the first installation kit 100 is used may be different from a surface in contact with the front panel 1100 when the auxiliary frame 1500 of the second installation kit 1000 is used.

The installation kit 1000 may include the front panel 1100. The front panel 1100 may be disposed to surround the case front end 13 (see FIG. 1) of the air conditioner 1 in the first space 93 (see FIG. 2) or the second space (see FIG. 2). The installation kit 1000 may have an opening 1001. The case 10 of the air conditioner 1 may pass through the opening 1001. The case 10 may be supported by the installation kit 1000 in the opening 1001. The opening 1001 may be formed in the front panel 1100.

The installation kit 1000 may include the first side frame 1200. The first side frame 1200 may be detached from the front panel 1100. The first side frame 1200 may be disposed behind the front panel 1100. The first side frame 1200 may extend in the vertical direction. A vertical length of the first side frame 1200 may be smaller than a vertical length of the front panel 110.

The installation kit 1000 may include the extension frame 1300. The extension frame 1300 may be detached from the front panel 1100. The extension frame 1300 may be disposed behind the front panel 1100. The extension frame 1300 may extend in the vertical direction. A vertical length of the extension frame 1300 may be smaller than the vertical length of the front panel 1100. The extension frame 1300 may be coupled to the first side frame 1200 so as to be movable in the vertical direction.

The installation kit 1000 may include the second side frame 1400. The second side frame 1400 may be detached from the front panel 1100. The second side frame 1400 may be disposed behind the front panel 1100. The second side frame 1400 may extend in the vertical direction. A vertical length of the second side frame 1400 may be smaller than the vertical length of the front panel 1100.

The first side frame 1200 and the second side frame 1400 may be horizontally spaced apart from each other. The opening 1001 may be formed between the first side frame 1200 and the second side frame 1400.

The first side frame 1200 may be disposed to face the window 92 (see FIG. 1). The second side frame 1400 may be disposed to face the window frame 91 (see FIG. 1). The extension frame 1300 may be disposed to face the window 92 (see FIG. 1).

The installation kit 1000 may include the auxiliary frame 1500. The auxiliary frame 1500 may be detached from the front panel 1100. The auxiliary frame 1500 may be disposed behind the front panel 1100. The auxiliary frame 1500 may extend in the vertical direction. A vertical length of the auxiliary frame 1500 may be smaller than the vertical length of the second side frame 1400. The auxiliary frame 1500 may be spaced above the second side frame 1400. The auxiliary frame 1500 may be horizontally spaced apart from the extension frame 1300. The auxiliary frame 1500 may be disposed at an upper end of the front panel 1100.

The installation kit 1000 may include an inner gasket 1600. The inner gasket 1600 may be disposed to at least partially surround the opening 1001. The inner gasket 1600 may be disposed to at least partially surround the case 10 (see FIG. 1). The inner gasket 1600 may be disposed between the case 10 and the installation kit 1000. The inner gasket 1600 may at least partially seal a space between the case 10 (see FIG. 1) and the front panel 1100.

The installation kit 1000 may include a holder (or clip) 1700. A plurality of holders 1700 may be horizontally spaced apart from each other. The holders 1700 may be coupled to the extension frame 1300. The holders 1700 may be coupled to the auxiliary frame 1500. The holders 1700 may protrude upward from the extension frame 1300. The holders 1700 may protrude upward from the auxiliary frame 1500. The holders 1700 may protrude further upward than the upper end of the front panel 1100. The holders 1700 may be fixed to the upper support 911 of the window frame 91 (see FIG. 1). The holders 1700 may serve to fix the installation kit 1000 to the window frame 91.

The first side frame 1200 and the extension frame 1300 may face the window 92 (see FIG. 1). A separate gasket (not shown) may be disposed in a space between the first side frame 1200 and the window 92 and a space between the extension frame 1300 and the window 92.

The second side frame 1400 may face the window frame 91 (see FIG. 1). The second side frame 1400 may face the side support 913 (see FIG. 1) of the window frame 91. The second side frame 1400 may contact the side support 913. However, a separate gasket (not shown) may be disposed between the second side frame 1400 and the side support 913.

Figure 17:
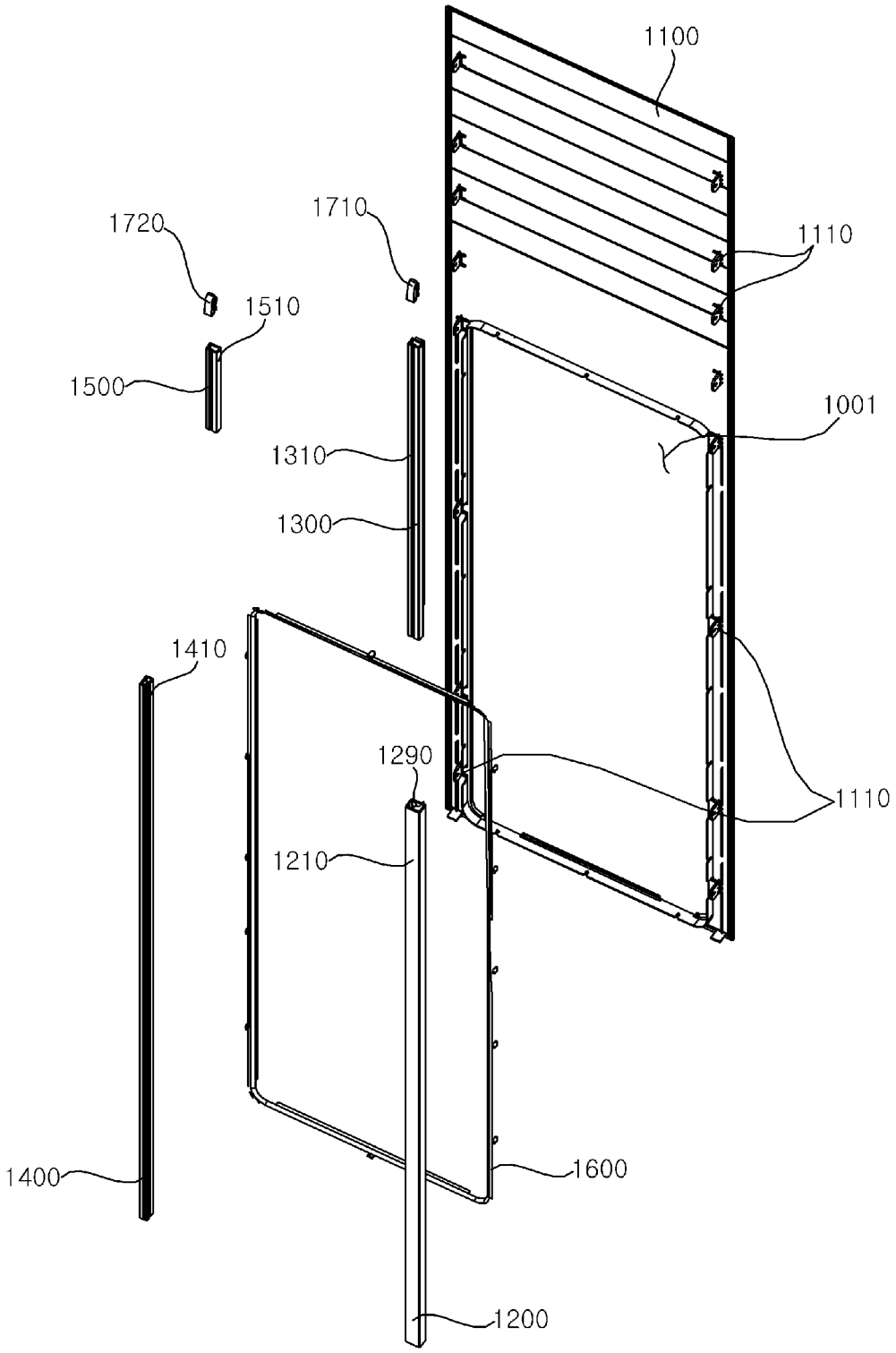
FIG. 17 is an exploded view of an installation kit according to an embodiment of the present disclosure.

Referring to FIG. 17, the installation kit 1000 will be described below. FIG. 17 is an exploded view of the installation kit 1000. The front panel 1100 may include coupling ribs 1110. A plurality of coupling ribs 1110 may be arranged to be vertically spaced apart from each other. The coupling ribs 1110 may protrude rearward from the front panel 1100. The coupling ribs 1110 may be formed on both sides of the front panel 1100.

The first side frame 1200 may be detached from the front panel 110. The first side frame 1200 may include a first side frame coupling part 1210. The first side frame coupling part 1210 may face the coupling ribs 1110. The first side frame coupling part 1210 may extend in the vertical direction. The first side frame 1200 may be coupled via a predetermined fastening member (not shown), such as fastening member 1120 shown in FIG. 21, that passes through the first side frame coupling part 1210 and the coupling ribs 1110 and into the window 92. However, a method of coupling the first side frame coupling part 1210 and the coupling ribs 1110 is not limited to the above example.

The second side frame 1400 may be detached from the front panel 1100. The second side frame 1400 may include a second side frame coupling part 1410. The second side frame coupling part 1410 may face the coupling ribs 1110. The second side frame coupling part 1410 may extend in the vertical direction. The second side frame 1400 may be coupled via a predetermined fastening member (not shown), such as fastening member 1120 shown in FIG. 21, that passes through the second side frame coupling part 1410 and the coupling ribs 1110 and into the window frame 91. However, a method of coupling the second side frame coupling part 1410 and the coupling ribs 1110 is not limited to the above example.

The extension frame 1300 may be detached from the front panel 1100. The extension frame 1300 may include an extension frame coupling part 1310. The extension frame coupling part 1310 may face the coupling ribs 111. The extension frame coupling part 1310 may extend in the vertical direction. The extension frame 1300 may be coupled via a predetermined fastening member (not shown) that passes through the extension frame coupling part 1310 and the coupling ribs 1110 and into the window 92. However, a method of coupling the extension frame coupling part 1310 and the coupling ribs 1110 is not limited to the above example.

The first side frame 1200 may include an extension frame insertion part (or extension frame insertion slot) 1290. The extension frame 1300 may be disposed in the extension frame insertion part 1290 so as to be movable in the vertical direction. The extension frame 1300 may move in the extension frame insertion part 1290 to protrude upward from the first side frame 1200.

The auxiliary frame 1500 may be detached from the front panel 1100. The auxiliary frame 1500 may include an auxiliary frame coupling part 1510. The auxiliary frame coupling part 1510 may face the coupling ribs 111. The auxiliary frame coupling part 1510 may extend in the vertical direction. The auxiliary frame 1500 may be coupled via a predetermined fastening member (not shown) that passes through to the auxiliary frame coupling part 1510 and the coupling ribs 111 and into the window frame 91. However, a method of coupling the auxiliary frame coupling part 1510 and the coupling ribs 1110 is not limited to the above example.

The holders 1700 may include a first holder 1710 and/or a second holder 1720. The first holder 1710 may be coupled to the extension frame 1300. The second holder 1720 may be coupled to the auxiliary frame 1500.

Figure 18:
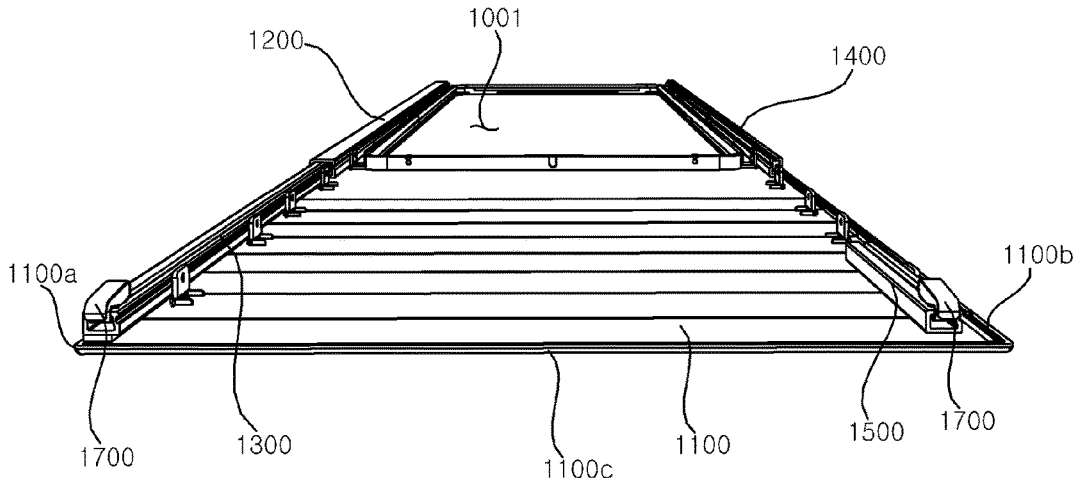
FIG. 18 is a perspective view of an installation kit according to an embodiment of the present disclosure.
Figure 19:
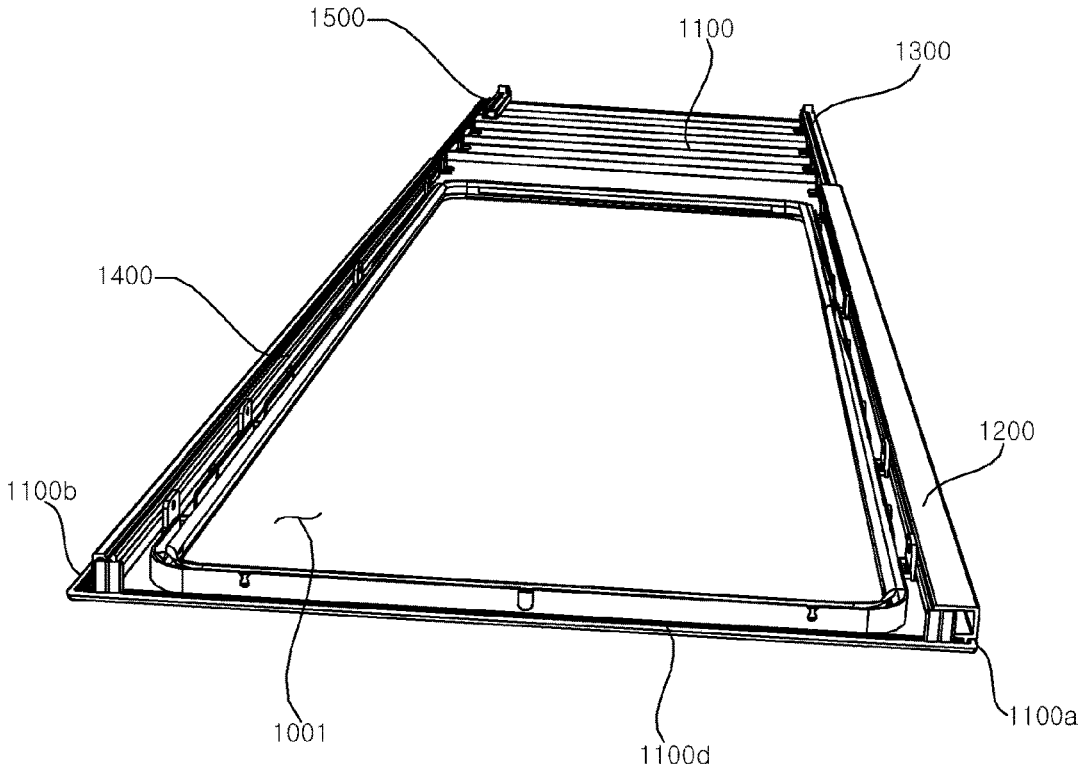
FIG. 19 is a perspective view of an installation kit according to an embodiment of the present disclosure.

Referring to FIGS. 18 and 19, the installation kit 1000 will be described below. FIG. 18 is a diagram illustrating the installation kit 1000 as viewed obliquely from top to bottom. FIG. 19 is a diagram illustrating the installation kit 1000 as viewed obliquely from bottom to top.

With respect to the opening 1001, a first coupling part (or first coupling region) 1100*a* may be disposed on one side of the opening 1001, and a second coupling part (or second coupling region) 1100*b* may be disposed on another side of the opening 1001. The opening 1001 may be disposed between the first side frame 1200 and the second side frame 1400. The extension frame 1300 may be disposed on an upper side of the first side frame 1200. The auxiliary frame 1500 may be spaced above the second side frame 1400.

The front panel 1100 may include the first coupling part 1100*a*. The first coupling part 1100*a* may be spaced apart from one side of the opening 1001. The first coupling part 1100*a* may extend in the vertical direction. Similarly, the front panel 1100 may include a second coupling part 1100*b*. The second coupling part 1100*b* may be spaced apart from one side of the opening 1001. The second coupling part 1100*b* may extend in the vertical direction. The first coupling part 1100*a* and the second coupling part 1100*b* may be horizontally spaced apart from each other. The first coupling part 1100*a* and the second coupling part 1100*b* may be symmetrical about the opening 1001.

The first side frame 1200 may be disposed on one of the first coupling part 1100*a* or the second coupling part 1100*b*. The extension frame 1300 may be disposed on the one of the first coupling part 1100*a* or the second coupling part 1100*b* at which the first side frame 1200 is positioned. The second side frame 1400 may be disposed on the other one of the first coupling part 1100*a* or the second coupling part 1100*b*.

The front panel 1100 may include a panel upper end 1100*c*. The panel upper end 1100*c* may be spaced above the opening 1001. The extension frame 1300 may extend toward the panel upper end 1100*c*. An upper end of the extension frame 1300 may be disposed at the panel upper end 1100*c*.

The auxiliary frame 1500 may extend toward the panel upper end 1100*c*. An upper end of the auxiliary frame 1500 may be disposed at the panel upper end 1100*c*. The holders 1700 may protrude upward from the panel upper end 1100*c*. The holders 1700 may protrude upward from each of the extension frame 1300 and the auxiliary frame 1500.

The front panel 1100 may include a panel lower end 1100*d*. The panel lower end 1100*d* may be spaced below the opening 1001. A lower end of the first side frame 1200 may be disposed at the panel lower end 1100*d*. A lower end of the second side frame 1400 may be disposed at the panel lower end 1100*d*.

Figure 20:
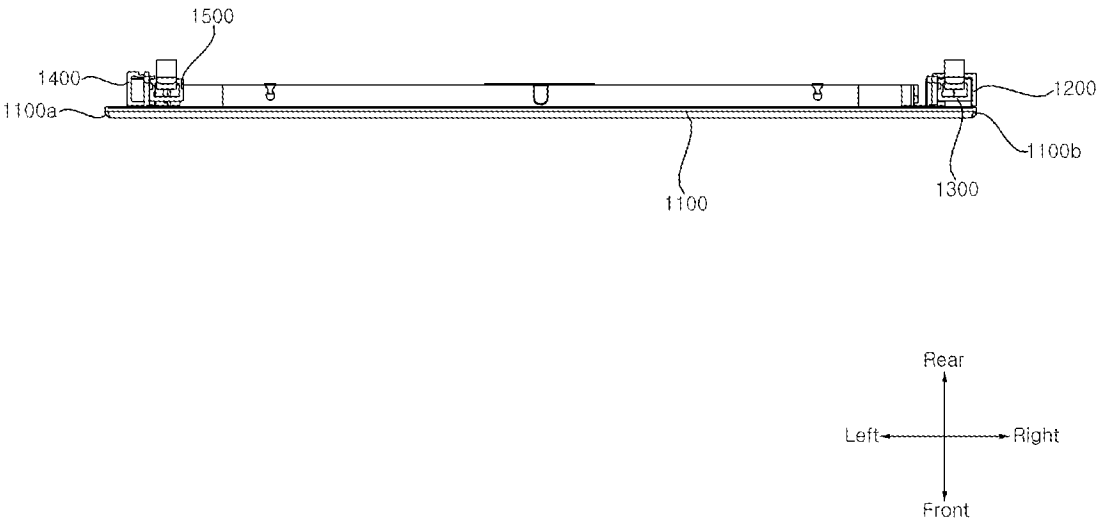
FIG. 20 is a top view of an installation kit according to an embodiment of the present disclosure.

Referring to FIGS. 9 and 20, the air conditioner 1 and the installation kit 1000 will be described below. FIG. 20 is a diagram illustrating the installation kit 1000 as viewed from top to bottom, when the installation kit 1000 is installed as illustrated in FIG. 9. The air conditioner 1 and the installation kit 1000 may be selectively disposed in the first space 93 or the second space 94.

The air conditioner 1 and the installation kit 1000 may be disposed between the first side support 913*a* and the window 92. The first side frame 1200 and the extension frame 1300 may be coupled to the second coupling part 1100*b* of the front panel 1100. The first side frame 1200 and the extension frame 1300 may be disposed to face the windows 921 and 922. The second side frame 1400 and the auxiliary frame 1500 may be coupled to the first coupling part 1100*a*. The second side frame 1400 and the auxiliary frame 1500 may be disposed to face the window frame 913*a*.

Figure 21:
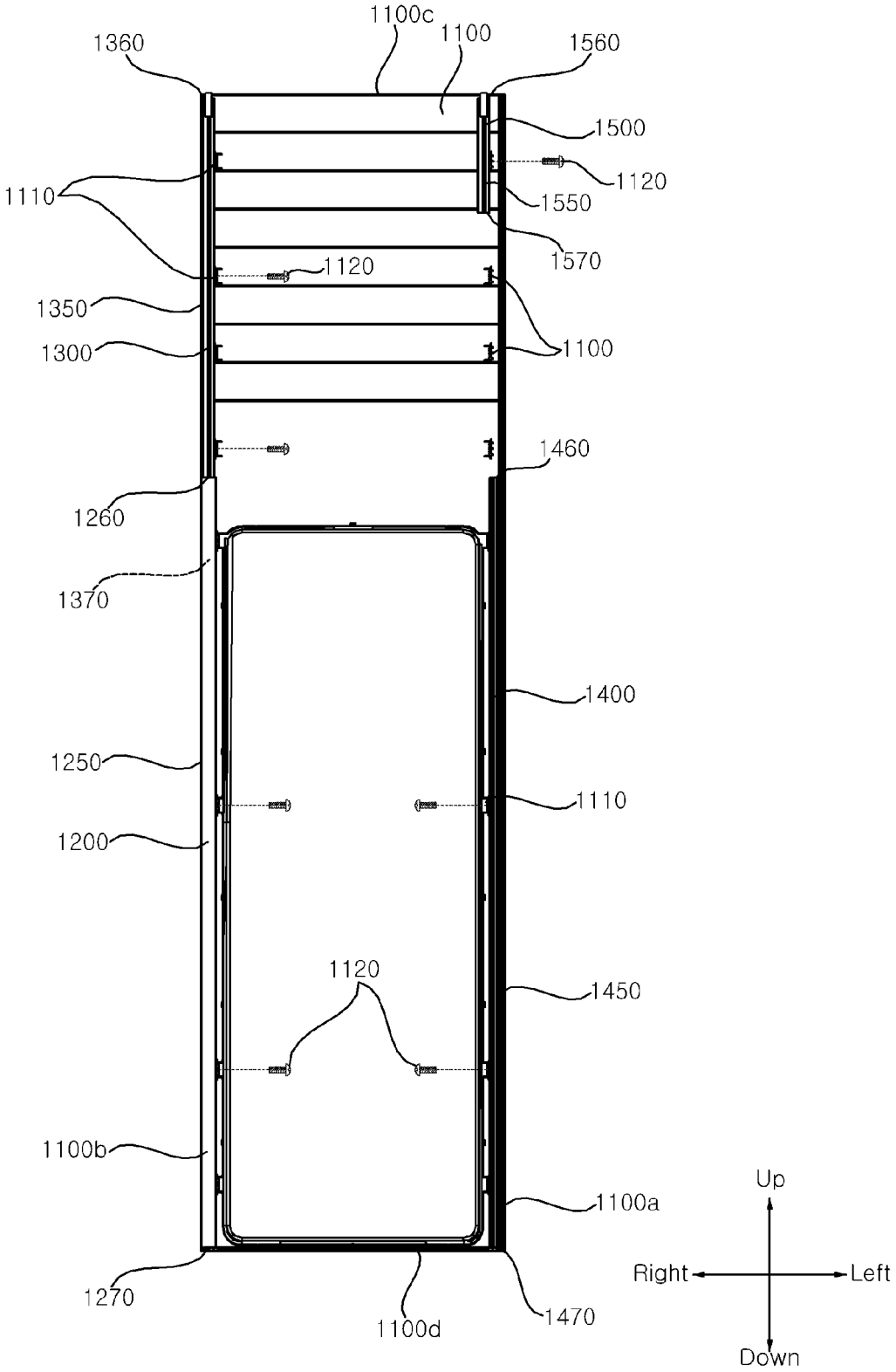
FIG. 21 is a rear view of an installation kit according to an embodiment of the present disclosure.

Referring to FIGS. 9 and 21, the installation kit 1000 will be described below. FIG. 21 is a diagram illustrating the installation kit 1000 as viewed from the rear, when the installation kit 1000 is installed as illustrated in FIG. 9.

The first side frame 1200 may include a first end 1260. The first end 1260 may form one end surface of the first side frame 1200. The first side frame 1200 may include a second end 1270. The second end 1270 may form another end surface of the first side frame 1200. The first side frame 1200 may extend from the first end 1260 toward the second end 1270.

The second side frame 1400 may include a first side end 1460. The first side end 1460 may form one end surface of the second side frame 1400. The second side frame 1400 may include a second side end 1470. The second side end 1470 may form another end surface of the second side frame 1400. The second side frame 1400 may extend from the first side end 1460 toward the second side end 1470.

The extension frame 1300 may include a first extension frame end 1360. The first extension frame end 1360 may form one end surface of the extension frame 1300. The extension frame 1300 may include a second extension frame end 1370. The second extension frame end 1370 may form another end surface of the extension frame 1300. The extension frame 1300 may extend from the first extension frame end 1360 toward the second extension frame end 1370.

The auxiliary frame 1500 may include a first auxiliary frame end 1560. The first auxiliary frame end 1560 may form one end surface of the auxiliary frame 1500. The auxiliary frame 1500 may include a second auxiliary frame end 1570. The second auxiliary frame end 1570 may form another end surface of the auxiliary frame 1500. The auxiliary frame 1500 may extend from the first auxiliary frame end 1560 to the second auxiliary frame end 1570. The auxiliary frame 1500 may include an auxiliary frame outer surface 1550. The auxiliary frame outer surface 1550 may face the coupling ribs 1110.

The installation kit 1000 may include a fastening member 1120. A plurality of fastening members 1120 may be provided to correspond to the plurality of coupling ribs 1110.

When the installation kit 1000 is installed as illustrated in FIG. 9, the first end 1260 may be disposed above the second end 1270. The first end 1260 may be disposed above the opening 1001. The second end 1270 may be disposed at the panel lower end 1100*d*.

When the installation kit 1000 is installed as illustrated in FIG. 9, the first outer surface 1250 may face one of the windows 921 or 922. When the installation kit 1000 is installed as illustrated in FIG. 9, the first side frame coupling part 1210 (see FIG. 17) may face the coupling ribs 1110. The fastening members 1120 pass through the first side frame coupling part 1210 and the coupling ribs 1110 so that the first side frame 1200 may be coupled to the front panel 1100.

When the installation kit 1000 is installed as illustrated in FIG. 9, the first side end 1460 may be disposed above the second side end 1470. The first side end 1460 may be disposed above the opening 1001. The second side end 1470 may be disposed at the panel lower end 110*d*.

When the installation kit 1000 is installed as illustrated in FIG. 9, the second outer surface 1450 may face the window frame 913*a*. When the installation kit 1000 is installed as illustrated in FIG. 9, the second side frame coupling part 1410 (see FIG. 17) may face the coupling ribs 1110. The fastening members 1120 pass through the second side frame coupling part 1410 and the coupling ribs 1110 so that the second side frame 1400 may be coupled to the front panel 1100.

When the installation kit 1000 is installed as illustrated in FIG. 9, the first extension frame end 1360 may be disposed above the second extension frame end 1370. The first extension frame end 1360 may be disposed at the panel upper end 1100*c*. The second extension frame end 1370 may be disposed inside the first side frame 1200. The holders 1700 may be coupled to the first extension frame end 1360.

When the installation kit 1000 is installed as illustrated in FIG. 9, the extension frame outer surface 1350 may face one of the windows 921 and 922. When the installation kit 1000 is installed as illustrated in FIG. 9, the extension frame coupling part 1310 (see FIG. 17) may face the coupling ribs 1110. The fastening members 1120 pass through the extension frame coupling part 1310 and the coupling ribs 1110 so that the extension frame 1300 may be coupled to the front panel 1100.

When the installation kit 1000 is installed as illustrated in FIG. 9, the first auxiliary frame end 1560 may be disposed above the second auxiliary frame end 1570. The first auxiliary frame end 1560 may be disposed at the panel upper end 1100*c*. The second auxiliary frame end 1570 may be spaced above the second side frame 1400. The holders 1700 may be coupled to the first auxiliary frame end 1560.

When the installation kit 1000 is installed as illustrated in FIG. 9, the auxiliary frame outer surface 1550 may face the window frame 913*a*. Similarly, when the installation kit 1000 is installed as illustrated in FIG. 9, the auxiliary frame coupling part 1510 (see FIG. 17) may face the coupling ribs 1110. The fastening members 1120 pass through the auxiliary frame coupling part 1510 and the coupling ribs 1110 so that the auxiliary frame 1500 may be coupled to the front panel 1100.

Figure 22:
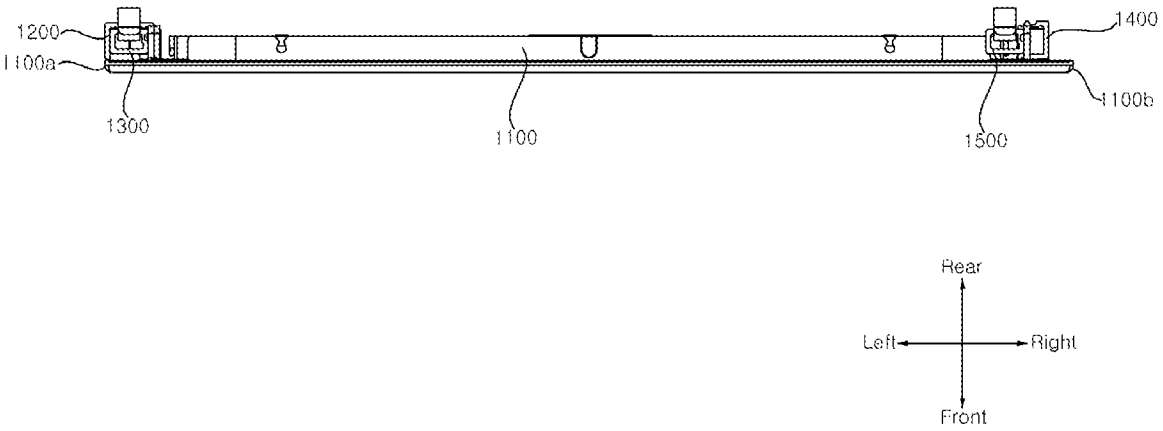
FIG. 22 is a top view of an installation kit according to an embodiment of the present disclosure.

Referring to FIGS. 12 and 22, the installation kit 1000 will be described below. FIG. 22 is a diagram illustrating the installation kit 1000 as viewed from top to bottom, when the installation kit 1000 is installed as illustrated in FIG. 12.

The installation kit 1000 may be selectively disposed in the first space 93 or the second space 94 so that the air conditioner 1 may be selectively disposed in the first space 93 or the second space 94. For example, the air conditioner 1 and the installation kit 1000 may be disposed between the second side support 913*b* and the window 92.

The first side frame 1200 and the extension frame 1300 may be coupled to the first coupling part 1100*a* of the front panel 1100. The first side frame 1200 and the extension frame 1300 may be disposed to face the windows 921 and 922. The second side frame 1400 and the auxiliary frame 1500 may be coupled to the second coupling part 110*b*. The second side frame 1400 and the auxiliary frame 1500 may be disposed to face the window frame 913*a*.

Figure 23:
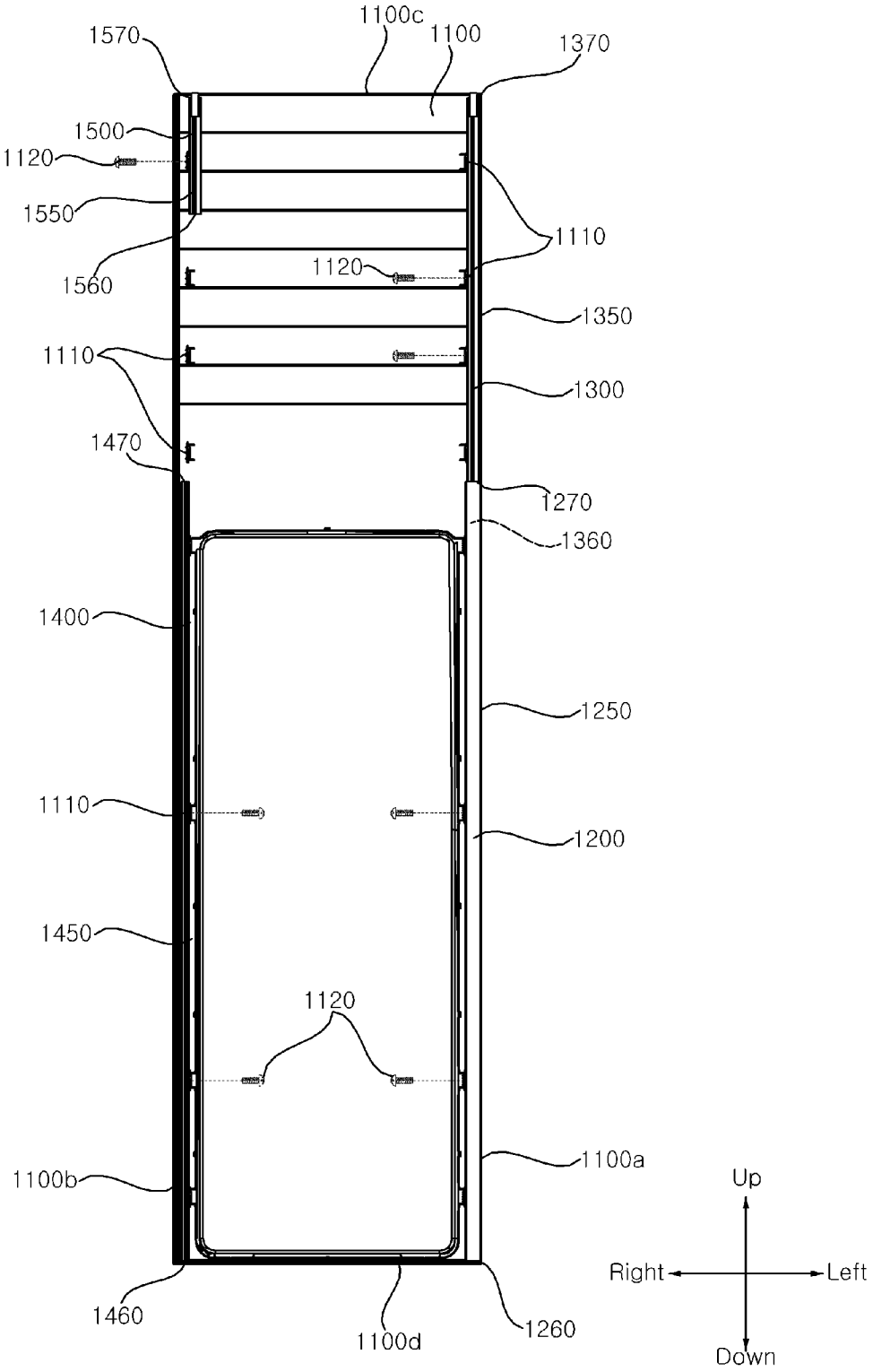
FIG. 23 is a rear view of an installation kit according to an embodiment of the present disclosure.

Referring to FIGS. 12 and 23, the installation kit 1000 will be described below. FIG. 23 is a diagram illustrating the installation kit 1000 as viewed from the rear, when the installation kit 1000 is installed as illustrated in FIG. 12.

When the installation kit 1000 is installed as illustrated in FIG. 12, the second end 1270 may be disposed above the first end 1260. The second end 1270 may be disposed above the opening 1001. The first end 1260 may be disposed at the panel lower end 1100*d*. When the installation kit 1000 is installed as illustrated in FIG. 12, the first outer surface 1250 may face one of the windows 921 and 922.

When the installation kit 1000 is installed as illustrated in FIG. 12, the first side frame coupling part 1210 (see FIG. 17) may face the coupling ribs 1110. The fastening members 1120 pass through the first side frame coupling part 1210 and the coupling ribs 1110 so that the first side frame 1200 may be coupled to the front panel 1100.

When the installation kit 1000 is installed as illustrated in FIG. 12, the second side end 1470 may be disposed above the first side end 1460. The second side end 1470 may be disposed above the opening 1001. The first side end 1460 may be disposed at the panel lower end 1100*d*. Similarly, when the installation kit 1000 is installed as illustrated in FIG. 12, the second outer surface 1450 may face the window frame 913*b*.

When the installation kit 1000 is installed as illustrated in FIG. 12, the second side frame coupling part 1410 (see FIG. 17) may face the coupling ribs 1110. The fastening members 1120 pass through the second side frame coupling part 1410 and the coupling ribs 1110 so that the second side frame 1400 may be coupled to the front panel 1100.

When the installation kit 1000 is installed as illustrated in FIG. 12, the second extension frame end 1370 may be disposed above the first extension frame end 1360. The second extension frame end 1370 may be disposed at the panel upper end 1100*c*. The first extension frame end 1360 may be disposed inside the first side frame 1200. The holders 1700 may be coupled to the second extension frame end 1370. Additionally when the installation kit 1000 is installed as illustrated in FIG. 12, the extension frame outer surface 1350 may face the windows 921 and 922.

When the installation kit 100 is installed as illustrated in FIG. 12, the extension frame coupling part 1310 (see FIG. 17) may face the coupling ribs 1110. The fastening members 1120 pass through the extension frame coupling part 1310 and the coupling ribs 1110 so that the extension frame 1300 may be coupled to the front panel 1100.

When the installation kit 1000 is installed as illustrated in FIG. 12, the second auxiliary frame end 1570 may be disposed above the first auxiliary frame end 1560. The second auxiliary frame end 1570 may be disposed at the panel upper end 1100*c*. The first auxiliary frame end 1560 may be spaced above the second side frame 1400. The holders 1700 may be coupled to the second auxiliary frame end 1570. Additionally, when the installation kit 1000 is installed as illustrated in FIG. 12, the auxiliary frame outer surface 1550 may face the window frame 913*b*.

When the installation kit 1000 is installed as illustrated in FIG. 12, the auxiliary frame coupling part 1510 (see FIG. 17) may face the coupling ribs 1110. The fastening members 1120 pass through the auxiliary frame coupling part 1510 and the coupling ribs 1110 so that the auxiliary frame 1500 may be coupled to the front panel 1100.

Upon comparison of FIGS. 21 and 23, the upper end and the lower end of each of the first side frame 1200, the second side frame 1400, the extension frame 1300, and the auxiliary frame 1500 may be opposite each other. For example, the first side frame 1200 may be coupled to the second coupling part 1100*b* and the first end 1260 may be disposed above the second end 1270 in FIG. 21, whereas in FIG. 23, the first side frame 1200 may be coupled to the first coupling part 1100*a* and the first end 1260 may be disposed below the second end 1270. Accordingly, by coupling the first side frame 1200 to the first coupling part 1100*a* by simply turning the first side frame 1200 upside down, a user may change an installation location of the installation kit 1000 from the first space 93 to the second space 94.

Additionally, the second side frame 1400 may be coupled to the first coupling part 1100*a* and the first side end 1460 may be disposed above the second side end 1470 in FIG. 21, whereas in FIG. 23, the second side frame 1400 may be coupled to the second coupling part 1100*b* and the first side end 1460 may be disposed below the second side end 1470. Accordingly, by coupling the second side frame 1400 to the second coupling part 1100*b* by simply turning the second side frame 1400 upside down, a user may change an installation location of the installation kit 1000 from the first space 93 to the second space 94.

Additionally, the extension frame 1300 may be coupled to the second coupling part 1100*b* and the first extension frame end 1360 may be disposed above the second extension frame end 1370 in FIG. 21, whereas in FIG. 23, the extension frame 1300 may be coupled to the first coupling part 1100*a* and the first extension frame end 1360 may be disposed below the second extension frame end 1370. Accordingly, by coupling the extension frame 1300 to the first coupling part 1100*a* by simply turning the extension frame 1300 upside down, a user may change an installation location of the installation kit 1000 from the first space 93 to the second space 94.

Additionally, the auxiliary frame 1500 may be coupled to the first coupling part 1100*a* and the first auxiliary frame end 1560 may be disposed above the second auxiliary frame end 1570 in FIG. 21, whereas in FIG. 23, the auxiliary frame 1500 may be coupled to the second coupling part 1100*b* and the first auxiliary frame end 1560 may be disposed below the second auxiliary frame end 1570. Accordingly, by coupling the auxiliary frame 1500 to the second coupling part 1100*b* by simply turning the auxiliary frame 1500 upside down, a user may change an installation location of the installation kit 1000 from the first space 93 to the second space 94.

Accordingly, an aspect of the present disclosure is to facilitate installation of an air conditioner in a window. It is yet another aspect of the present disclosure to provide an installation kit that supports an air conditioner. It is yet another aspect of the present disclosure to simplify a structure of an installation kit. It is yet another aspect of the present disclosure to facilitate installation of an installation kit. It is yet another aspect of the present disclosure to provide an installation kit having an adjustable height. It is yet another aspect of the present disclosure to simplify a process of adjusting height of an installation kit. It is yet another aspect of the present disclosure to reduce noise and vibration of an air conditioner. It is yet another aspect of the present disclosure to prevent damage to an air conditioner caused by a window frame and a window. It is yet another aspect of the present disclosure to prevent entry of water, generated in an air conditioner, or rainwater into an indoor space. It is yet another aspect of the present disclosure to improve the appearance of a window-mounted air conditioner. It is yet another aspect of the present disclosure to facilitate installation of an air conditioner at various positions of a window. It is yet another aspect of the present disclosure to provide an installation kit capable of being easily assembled even when a position of an air conditioner is changed. The aspects of the present disclosure are not limited to the aforementioned aspects and other aspects not described herein will be clearly understood by those skilled in the art from the foregoing description.

In accordance with the present disclosure, the above and other aspects can be accomplished by providing an installation kit including a front panel disposed to cover an indoor side of a space in which an air conditioner is disposed between a window frame and a window. The front panel may have an opening through which the air conditioner is inserted. The installation kit may include a first side frame coupled to the front panel. The first side frame may be disposed to face the window.

The installation kit may include a second side frame coupled to the front panel. The second side frame may be disposed to face the window frame.

The window frame may include a window frame front end having one surface facing an indoor space. The front panel may be coupled to the window frame front end.

The air conditioner may include a case passing through the opening to protrude forward of the front panel. The air conditioner may include an outlet formed at a front of the front panel.

The installation kit may further include a window gasket disposed between the first side frame and the window. The installation kit may further include an extension frame disposed so as to be movable in a vertical direction relative to the first side frame. The extension frame may extend from the first side frame toward an upper end of the front panel. The installation kit may further include an auxiliary frame spaced above the second side frame.

The front panel may include a first coupling part to which one of the first side frame and the second side frame is coupled. The front panel may include a second coupling part to which one of the first side frame and the second side frame is coupled. A first space and a second space, which are separated from each other, may be formed between the window frame and the window at positions horizontally spaced apart from each other.

The first side frame may include a first end and a second end which are spaced apart from each other. The second side frame may include a first side end and a second side end which are spaced apart from each other. The extension frame may include a first extension frame end and a second extension frame end which are spaced apart from each other.

The installation kit may include an installation frame disposed between a window frame and a window and having a space formed therein in which an air conditioner is disposed. The front panel may be disposed closer to an indoor side than the installation frame to cover a front side of the installation frame. The case may have a case lower end mounted on the installation frame.

The case lower end may be spaced apart from a lower portion of the window frame at a position between the front panel and the installation frame. The case lower end may be mounted on the front panel in front of the installation frame. The air conditioner may include a compressor disposed in the case and configured to circulate refrigerant. The front panel may support the case in front of the compressor.

Other detailed matters of the exemplary embodiments are included in the detailed description and the drawings. According to at least one embodiment of the present disclosure, an air conditioner may be stably supported by an installation kit. According to at least one embodiment of the present disclosure, by facilitating coupling between an installation kit and a window frame or a window, the air conditioner may be simply installed.

According to at least one embodiment of the present disclosure, by providing a side frame which is detachable from a front panel, an installation kit may be easily assembled. According to at least one embodiment of the present disclosure, by providing a structure in which a portion of a front panel is cut, the height of an installation kit may be easily adjusted.

According to at least one embodiment of the present disclosure, by providing a sliding structure of a side frame, the height of an installation kit may be easily adjusted. According to at least one embodiment of the present disclosure, an installation kit is provided at the front of an air conditioner, thereby reducing noise and vibration generated by the air conditioner.

According to at least one embodiment of the present disclosure, a side frame is provided between a window and an air conditioner, thereby preventing damage to the air conditioner caused by the window. According to at least one embodiment of the present disclosure, an installation kit is disposed at the front of an air conditioner, thereby preventing water generated in an air conditioner or outside rainwater from entering an indoor space.

According to at least one embodiment of the present disclosure, a case of an air conditioner is made of the same material as an installation kit, thereby improving the appearance, minimizing friction between the installation kit and the case of the air conditioner, and reducing vibration and noise generated at a joint between the case of the air conditioner and the installation kit. According to at least one embodiment of the present disclosure, first and second side frames are detachable from both sides of a front panel, such that coupling positions of the first and second side frames may be easily adjusted. According to at least one embodiment of the present disclosure, by switching positions of first and second side frames that are coupled to a front panel, an installation kit may be easily installed at various positions of a window.

The effects of the present disclosure are not limited to the aforesaid, and other effects not described herein will be clearly understood by those skilled in the art from the following description of the appended claims.

While the preferred embodiments have been particularly shown and described, the present specification shall not be limited to the particular embodiments described above, and it will be understood by an ordinary skilled person in the art that various changes in form and details may be made therein without departing from the spirit and scope of the present invention as defined by the following claims, and the alternative embodiments should not be individually understood from the inventive concept and prospect of the present disclosure.

It will be apparent to those skilled in the art that various modifications and variations can be made, and thus, the present disclosure should not be construed as being limited to the aforementioned embodiments. Therefore, it is intended that the present disclosure cover the modifications and variations of this disclosure provided they come within the scope of the appended claims and their equivalents.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An installation kit, comprising: a front panel provided in a space between a window frame and a window that moves in a left-right direction, the front panel having an opening configured to receive an air conditioner; a first side frame disposed at a rear of the front panel and between the window and a case of the air conditioner; a second side frame disposed at the rear of the front panel, spaced apart from the first side frame, and disposed between the window frame and the case; and a window gasket disposed apart from the front panel and coupled to the first side frame, wherein the window gasket is disposed between the window and the first side frame.

2. The installation kit of claim 1, wherein the front panel is coupled to a front end of the window frame, the front end of the window frame having at least one surface facing an indoor space.

3. The installation kit of claim 1, wherein the opening is configured to receive the air conditioner such that a portion of a case of the air conditioner is positioned between the window frame and the window, another portion of the case passes through the opening to protrude forward of the front panel, and an outlet of the air conditioner is provided in front of the front panel.

4. The installation kit of claim 1, further comprising an extension frame coupled to the front panel and positioned to face the window, wherein the extension fame is configured to be movable in a vertical direction relative to the first side frame, and the extension frame extends from the first side frame toward an upper end of the front panel.

5. The installation kit of claim 1, further comprising an auxiliary frame coupled to the front panel and positioned to face the window frame, the auxiliary frame being positioned above and spaced apart from the second side frame.

6. The installation kit of claim 1, wherein a front-to-back width of the first side frame is greater than a front-to-back width of the second side frame.

7. The installation kit of claim 1, wherein a rear surface of the front panel includes:

a first coupling region which is formed on a first side of the opening in the left-right direction and to which one of the first side frame or the second side frame is coupled; and a second coupling region which is formed on a second side of the opening in the left-right direction and to which another one of the first side frame or the second side frame is coupled.

8. The installation kit of claim 7, wherein the space between the window frame and the window includes a first space and a second space that are formed between the window frame and the window at positions horizontally spaced apart from each other, and wherein:

when the installation kit is positioned in the first space, the first coupling region is closer to the window than to the window frame, and the second coupling region is closer to the window frame than to the window; and when the installation kit is positioned in the second space, the first coupling region is closer to the window frame than to the window, and the second coupling region is closer to the window than to the window frame.

9. The installation kit of claim 7, wherein the space between the window frame and the window includes a first space and a second space that are formed between the window frame and the window at positions horizontally spaced apart from each other, and wherein:

the first side frame is coupled to the first coupling region when the installation kit is positioned in the first space and is coupled to the second coupling region when the installation kit is positioned in the second space; and the second side frame is coupled to the second coupling region when the installation kit is positioned in the first space and is coupled to the first coupling region when the installation kit is positioned in the second space.

10. The installation kit of claim 9, wherein the first side frame includes:

a first end; and a second end spaced apart from the first end, and wherein:

when the first side frame is coupled to the first coupling region, the first end is positioned above the second end; and when the first side frame is coupled to the second coupling region, the first end is positioned below the second end.

11. The installation kit of claim 9, wherein the second side frame includes:

a first end; and a second end spaced apart from the first end, and wherein:

when the second side frame is coupled to the second coupling region, the first end is positioned above the second end; and when the second side frame is coupled to the first coupling region, the first end is positioned below the second end.

12. The installation kit of claim 9, further comprising an extension frame coupled to one of the first coupling region or the second coupling region to which the first side frame is coupled, and inserted into the first side frame so as to be movable in a vertical direction, wherein the extension frame includes:

a first end; and a second end spaced apart from the first end, and wherein:

when the extension frame is coupled to the first coupling region, the second end is inserted into the first side frame; and when the extension frame is coupled to the second coupling region, the first end is inserted into the first side frame.

13. The installation kit of claim 9, further comprising an auxiliary frame spaced coupled to one of the first coupling region or the second coupling region to which the second side frame is coupled and above the second side frame.

14. An installation kit, comprising:

an installation frame positioned between a window frame and a window and having a space formed therein in which a portion of an air conditioner is received; and a front panel positioned closer to an indoor space than the installation frame to cover a front side of the installation frame, and having an opening through which another portion of the air conditioner is inserted.

15. The installation kit of claim 14, wherein the front panel is provided separately from the installation frame, and is spaced apart from the front side of the installation frame.

16. The installation kit of claim 14, wherein the window moves to open and close a space between the window frame and the window, wherein the installation frame is positioned in the space between the window frame and the window, and wherein the front panel is coupled to a front end of the window frame, which faces the indoor space, in front of the installation frame.

17. The installation kit of claim 14, wherein the air conditioner includes a case having a lower end mounted on the installation frame, and wherein the lower end of the case is spaced apart from a lower surface of the window frame between the front panel and the installation frame, and is mounted on the front panel in front of the installation frame.

18. The installation kit of claim 14, wherein the air conditioner includes:

a case mounted on the installation frame; and a compressor positioned in the case and configured to circulate refrigerant, and wherein the front panel supports a portion of the case that is in front of the compressor.

19. An air conditioner system comprising:

an air conditioner; and an installation kit disposed between the air conditioner and a window frame, wherein the installation kit comprises:

an installation frame positioned between the window frame and a window and having a space formed therein in which a portion of the air conditioner is received; and a front panel positioned closer to an indoor space than the installation frame to cover a front side of the installation frame, and having an opening through which another portion of the air conditioner is inserted.

* * * * *